US008679720B2

(12) United States Patent
Mitsuzawa et al.

(10) Patent No.: US 8,679,720 B2
(45) Date of Patent: Mar. 25, 2014

(54) LIQUID DEVELOPER AND IMAGE-FORMING APPARATUS

(75) Inventors: Kana Mitsuzawa, Shiojiri (JP); Masahiro Oki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 597 days.

(21) Appl. No.: 12/856,742

(22) Filed: Aug. 16, 2010

(65) Prior Publication Data

US 2011/0045400 A1 Feb. 24, 2011

(30) Foreign Application Priority Data

Aug. 20, 2009 (JP) ..... 2009-191457
Jun. 9, 2010 (JP) ..... 2010-132348

(51) Int. Cl.
*G03G 9/00* (2006.01)

(52) U.S. Cl.
USPC ..... 430/112; 430/115; 399/237

(58) Field of Classification Search
USPC ..... 430/112, 115; 399/237
See application file for complete search history.

(56) References Cited

U.S. PATENT DOCUMENTS

| | | | | |
|---|---|---|---|---|
| 4,687,811 | A * | 8/1987 | Sasaki et al. | 525/100 |
| 5,463,453 | A * | 10/1995 | Kurotori et al. | 399/249 |
| 2003/0032700 | A1 | 2/2003 | Morrison et al. | |
| 2004/0241567 | A1 * | 12/2004 | Teraoka et al. | 430/115 |
| 2007/0202432 | A1 * | 8/2007 | Akioka et al. | 430/115 |
| 2008/0032225 | A1 * | 2/2008 | Teshima et al. | 430/114 |
| 2010/0233614 | A1 * | 9/2010 | Teshima | 430/114 |

FOREIGN PATENT DOCUMENTS

| | | | |
|---|---|---|---|
| JP | 3332961 | B2 | 10/2002 |
| JP | 2003-176435 | A | 6/2003 |
| JP | 2004-302436 | A | 10/2004 |
| JP | 2007-328293 | A | 12/2007 |
| JP | 2009-053638 | A | 3/2009 |

* cited by examiner

*Primary Examiner* — Thorl Chea
(74) *Attorney, Agent, or Firm* — Nutter McClennen & Fish LLP; John J. Penny, Jr.; Christina M. Sperry

(57) ABSTRACT

A liquid developer contains toner, a carrier liquid in which the toner are dispersed, and a graft copolymer of an acrylic polymer and a polysiloxane.

12 Claims, 2 Drawing Sheets

LIQUID DEVELOPER AND IMAGE-FORMING APPARATUS

BACKGROUND

1. Technical Field

The present invention relates to liquid developers and image-forming apparatuses.

2. Related Art

Examples of methods for developing an electrostatic latent image formed on a latent image carrier using a developer include a method using a dry toner formed of a material containing a colorant, such as a pigment, and a binder resin in a dry process and a method using a liquid developer having toner dispersed in an electrically insulating liquid carrier (carrier liquid) (see, for example, JP-A-2009-53638).

The method using a dry toner is advantageous in terms of handling because it uses a solid toner, although it has problems such as the risk of an adverse effect of powder on, for example, the human body, contamination due to scattering of toner, and unevenness in toner dispersion. Another problem is that, because dry toner aggregate easily, it is difficult to sufficiently reduce the size of the toner, and it is therefore difficult to form a toner image with high resolution. In addition, the problems described above, resulting from the fact that a dry toner is in powder form, become more serious as the size of the toner is reduced.

On the other hand, the method using a liquid developer allows the use of toner finer than dry toner because the toner aggregate less easily in the liquid developer, and also allows the use of a binder resin having a lower melting point (lower softening temperature) than a resin material used for a dry toner. Thus, the method using a liquid developer provides superior reproducibility of fine-line images, superior tone reproducibility, and superior color reproducibility, and also serves as a superior method for high-speed image formation.

For liquid developers in the related art, however, it is difficult to provide sufficiently high dispersibility for toner in a carrier liquid because of a low affinity between the resin material used for the toner and the carrier liquid.

SUMMARY

An advantage of some aspects of the invention is that it provides a liquid developer having superior dispersion stability of toner and an image-forming apparatus using such a liquid developer.

A liquid developer according to a first aspect of the invention contains toner, a carrier liquid in which the toner are dispersed, and a graft copolymer of an acrylic polymer and a polysiloxane.

Thus, a liquid developer having superior dispersion stability of toner can be provided.

In the liquid developer according to the first aspect of the invention, the acrylic polymer preferably contains an alkyl acrylate as a monomer.

In this case, the effect of the acrylic-polysiloxane graft copolymer appears more significantly, thus providing particularly superior dispersion stability for the toner in the liquid developer.

In the liquid developer according to the first aspect of the invention, the polysiloxane is preferably dimethylpolysiloxane.

In this case, the effect of the acrylic-polysiloxane graft copolymer appears more significantly, thus providing particularly superior dispersion stability for the toner in the liquid developer.

In the liquid developer according to the first aspect of the invention, the polysiloxane is preferably dimethylpolysiloxane having an acrylic compound added thereto.

This provides particularly superior dispersion stability for the toner in the liquid developer.

In the liquid developer according to the first aspect of the invention, the graft copolymer is preferably contained in an amount of 10 to 50 parts by weight on the basis of 100 parts by weight of the toner.

In this case, the effect of the acrylic-polysiloxane graft copolymer appears sufficiently, and the liquid developer has appropriate viscosity.

In the liquid developer according to the first aspect of the invention, the toner preferably contain a silicone resin having partial structures represented by unit formulas (1) and (2):

$$R^1R^2R^3SiO_{1/2} \quad (1)$$

(where $R^1$, $R^2$, and $R^3$ are each independently a monovalent hydrocarbon group)

$$SiO_{4/2} \quad (2)$$

Such a silicone resin (MQ resin) does not easily dissolve into the carrier liquid in the liquid developer and has a high affinity with the acrylic-polysiloxane graft copolymer and the carrier liquid. Accordingly, if the toner contain such a resin, it provides particularly superior dispersion stability for the toner over an extended period of time.

In the liquid developer according to the first aspect of the invention, the toner preferably have surfaces modified with a polyalkyleneimine.

This provides particularly superior dispersion stability and positive charging properties for the toner.

In the liquid developer according to the first aspect of the invention, the toner are preferably formed of a resin material containing a rosin resin.

A rosin resin facilitates surface modification with a polyalkyleneimine because it has a large number of functional groups (acidic groups) highly reactive with a polyalkyleneimine, thus providing particularly superior positive charging properties for the liquid developer.

In the liquid developer according to the first aspect of the invention, the carrier liquid preferably contains at least one of a silicone oil and a siloxane compound.

In this case, the carrier liquid has a high affinity with the acrylic-polysiloxane graft copolymer, thus allowing the toner to be more stably dispersed in the carrier liquid.

An image-forming apparatus according to a second aspect of the invention includes a developing section that forms a monochrome image using a liquid developer, a transfer section that transfers the monochrome image formed by the developing section onto a recording medium to form an unfused toner image on the recording medium, and a fusing section that fuses the unfused toner image onto the recording medium. The liquid developer contains toner, a carrier liquid in which the toner are dispersed, and a graft copolymer of an acrylic polymer and a polysiloxane.

Thus, a reliable image-forming apparatus using a liquid developer having superior dispersion stability of toner can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
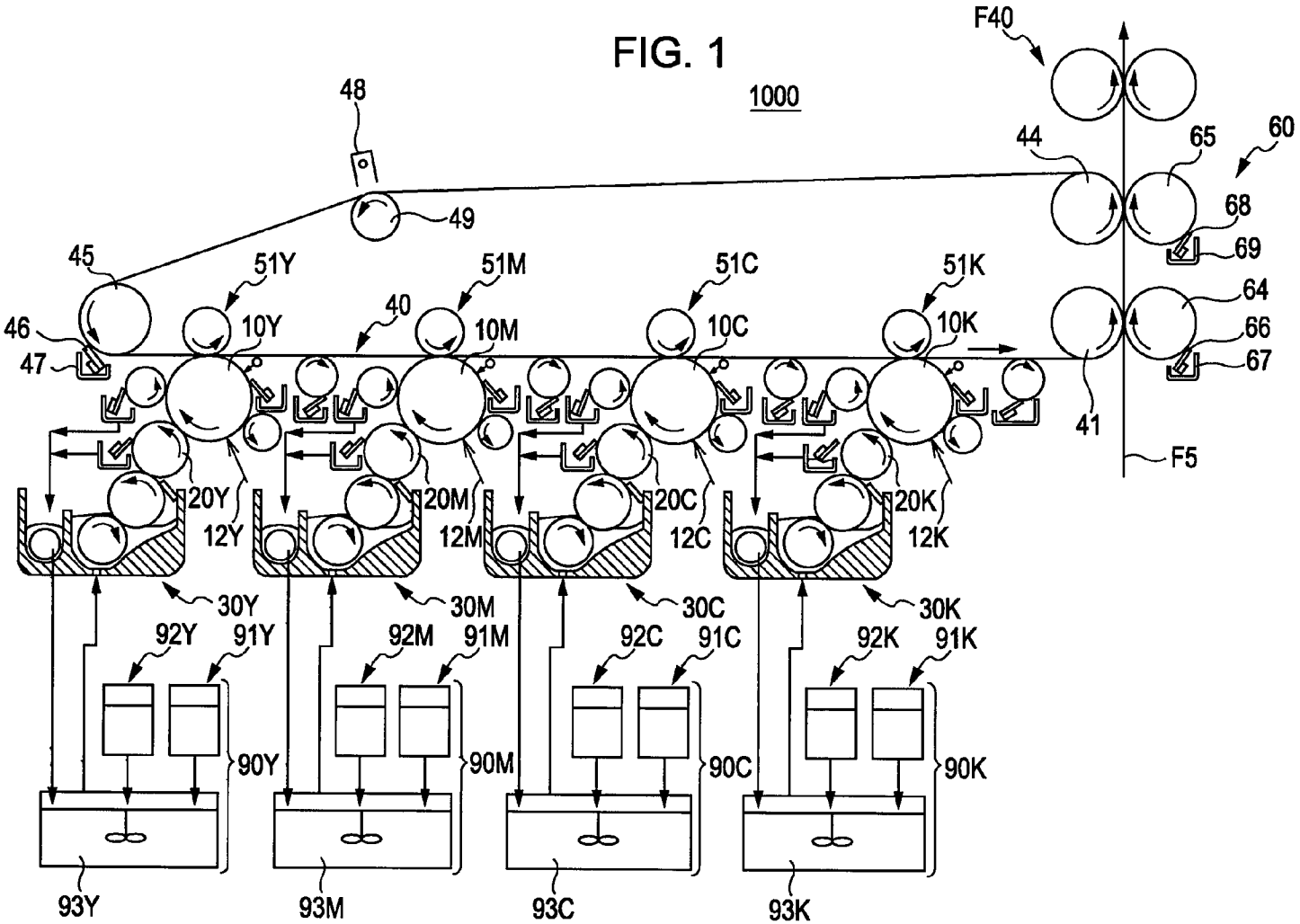
FIG. 1 is a schematic diagram of an image-forming apparatus according to a preferred embodiment of the invention.

Preferred embodiments of the invention will now be described in detail.

Liquid Developer

First, a liquid developer according to an embodiment of the invention will be described. The liquid developer according to this embodiment has toner dispersed in a carrier liquid. In addition, the liquid developer contains an acrylic-polysiloxane graft copolymer, described below, as a dispersant.

The individual components of the liquid developer will now be described in detail.

Acrylic-Polysiloxane Graft Copolymer

The liquid developer according to this embodiment contains a graft copolymer of an acrylic polymer and a polysiloxane (hereinafter referred to as "acrylic-polysiloxane graft copolymer"), which characterizes the liquid developer according to this embodiment.

In general, when an image is formed using a liquid developer, a charged latent image is formed on a photoreceptor, and toner are deposited on the latent image to form a toner image. Accordingly, the toner require charging properties, whereas a carrier liquid in which the toner migrate requires insulating properties. In this case, the toner, which are formed of a material with high polarity, have an insufficient affinity with the carrier liquid, which is formed of a material with low polarity. As a result, the toner aggregate in the carrier liquid, thus undesirably having insufficient dispersion stability in the liquid developer.

In contrast, the liquid developer according to this embodiment contains an acrylic-polysiloxane graft copolymer. (Meth)acrylic moieties in the acrylic-polysiloxane graft copolymer have relatively high polarity due to carbonyl groups in the backbones thereof. Polysiloxane moieties, on the other hand, have relatively low polarity. Thus, the (meth) acrylic moieties in the acrylic-polysiloxane graft copolymer have a high affinity with the toner, whereas the polysiloxane moieties have a high affinity with the carrier liquid. Being present between the toner and the carrier liquid, the acrylic-polysiloxane graft copolymer provides superior dispersion stability for the toner in the carrier liquid.

In addition, the acrylic-polysiloxane graft copolymer contained in the liquid developer prevents aggregation of the toner even though the toner have relatively high charging properties and the carrier liquid has relatively high insulating properties. That is, the acrylic-polysiloxane graft copolymer simultaneously provides superior development and transfer properties (which depend greatly on the charging properties of the toner) for the liquid developer and superior dispersion stability for the toner.

In addition, if the carrier liquid contains a hydrogen-modified silicone compound, described later, the acrylic-polysiloxane graft copolymer prevents deterioration of the hydrogen-modified silicone compound, thus preventing variations in the properties of the liquid developer.

Examples of the monomer used for the acrylic polymer include, but are not limited to, acrylic acid, methacrylic acid, and derivatives of acrylic acid and methacrylic acid such as alkyl acrylate esters and alkyl methacrylate esters, and they can be used alone or in a combination of two or more.

Examples of acrylic polymers formed of such monomers include a polymer formed of at least one monomer selected from acrylic acid, methacrylic acid, and alkyl esters thereof having four or less carbon atoms in the alkyl group thereof (i.e., acrylates).

In addition, the acrylic-polysiloxane graft copolymer may contain different types of acrylic polymers.

The acrylic polymer used for the acrylic-polysiloxane graft copolymer is preferably an acrylates/alkyl acrylate ester copolymer, more preferably an acrylates/ethylhexyl acrylate copolymer. In this case, the above effect of the acrylic-polysiloxane graft copolymer appears more significantly, thus providing particularly superior dispersion stability for the toner in the liquid developer.

The acrylic polymer may contain a monomer other than the above monomers.

Examples of the polysiloxane used for the acrylic-polysiloxane graft copolymer include, but are not limited to, dialkylpolysiloxanes such as dimethylpolysiloxane and diarylpolysiloxanes such as diphenylpolysiloxane, and they can be used alone or in a combination of two or more. Of these, the polysiloxane preferably contains a dialkylpolysiloxane and more preferably contains dimethylpolysiloxane. In this case, the above effect of the acrylic-polysiloxane graft copolymer appears more significantly, thus providing particularly superior dispersion stability for the toner in the liquid developer.

In addition, the polysiloxane used for the acrylic-polysiloxane graft copolymer may have a side chain or terminal thereof substituted by another functional group. For example, acrylic acid or methacrylic acid may be added to a side chain or terminal of the polysiloxane. This provides particularly superior dispersion stability for the toner in the liquid developer.

In addition, the polysiloxane may be either linear or branched.

In addition, the acrylic-polysiloxane graft copolymer is formed by graft polymerization of the acrylic polymer and the polysiloxane. Consequently, the acrylic-polysiloxane graft copolymer is bulky with many branched chains. This allows the moieties having relatively high polarity (acrylic polymer moieties) and the moieties having relatively low polarity (polysiloxane moieties) to deliver the functions thereof sufficiently.

Specific examples of the acrylic-polysiloxane graft copolymer described above include KP-541, KP-575, KP-543, KP-545, and KP-549 (manufactured by Shin-Etsu Chemical Co., Ltd.), and they can be used alone or in a combination of two or more.

The acrylic-polysiloxane graft copolymer is preferably contained in an amount of 10 to 50 parts by weight, more preferably 15 to 45 parts by weight, on the basis of 100 parts by weight of the toner. In this case, the effect of the acrylic-polysiloxane graft copolymer appears sufficiently, and the liquid developer has appropriate viscosity. If the content of the acrylic-polysiloxane graft copolymer in the liquid developer relative to that of the toner falls below the above lower limit, the effect of the acrylic-polysiloxane graft copolymer may appear insufficiently. On the other hand, if the content of the acrylic-polysiloxane graft copolymer in the liquid developer relative to that of the toner exceeds the above upper limit, the viscosity of the liquid developer may be extremely decreased, depending on the type of acrylic-polysiloxane graft copolymer, and consequently a problem may occur, such as dripping of the liquid developer from an application roller in an image-forming apparatus as described later.

Toner

Next, the toner will be described.

Constituent Materials of Toner

The toner contain at least a resin material and a colorant.

1. Resin Material (Binder Resin)

The toner are formed of a material containing a resin material as the major component thereof.

The resin material (binder resin) used in this embodiment is not particularly limited and may be, for example, a known resin. In particular, a resin having a functional group with high polarity, such as a carbonyl group or a carboxyl group, is preferably used. This allows a sufficient amount of acrylic-polysiloxane graft copolymer to adhere to the toner.

Examples of such resins include styrene-acrylic resins, acrylic resins, and polyester resins. In particular, a polyester resin is highly transparent and therefore allows a vivid image to be formed when used as a binder resin. In addition, a polyester resin facilitates surface modification with a polyalkyleneimine, described later, because it has a relatively large number of functional groups (acidic groups) highly reactive with a polyalkyleneimine, thus providing superior positive charging properties for the liquid developer.

In addition, the resin material preferably contains a rosin resin. A rosin resin facilitates surface modification with a polyalkyleneimine, described later, because it has a large number of functional groups (acidic groups) highly reactive with a polyalkyleneimine, thus providing particularly superior positive charging properties and dispersion stability for the liquid developer, for the reason described later. In addition, a rosin resin has a larger number of acidic groups and therefore attracts a larger number of protons originating from a hydrogen-modified silicone compound, described later, than a polyester resin, thus providing further superior positive charging properties for the liquid developer. In addition, a rosin resin makes the toner more fusible because it has a high affinity with recording media such as paper.

Examples of rosin resins include rosin-modified phenolic resins, rosin-modified maleic resins, rosin-modified polyester resins, fumaric-modified rosin resins, and ester gum, and they can be used alone or in a combination of two or more.

In addition, the rosin resin preferably has a weight average molecular weight of 500 to 100,000, more preferably 1,000 to 80,000, and most preferably 1,000 to 50,000. This provides a better balance of fusion properties and thermal storage stability for the toner.

In addition, the rosin resin preferably has an acid value of 40 mg KOH/g or less, more preferably 30 mg KOH/g or less, and most preferably 5 to 25 mg KOH/g. This provides a better balance of fusion properties and thermal storage stability for the toner.

In addition, the content of the rosin resin in the resin material used for the toner is preferably 1 to 50% by weight, more preferably 5% to 40% by weight. This provides a better balance of fusion properties and thermal storage stability for the toner.

The softening point of the resin material is preferably, but is not limited to, 50° C. to 130° C., more preferably 50° C. to 120° C., and most preferably 60° C. to 115° C. The term "softening point" as used herein refers to a temperature at which softening begins in a Koka-type flow tester (manufactured by Shimadzu Corporation) at a heating speed of 5° C./min and a die orifice diameter of 1.0 mm.

2. Colorant

In addition, the toner may contain a colorant. The colorant used is not particularly limited and may be, for example, a known pigment or dye.

3. Polyalkyleneimine

The surfaces of the toner are preferably modified with a polyalkyleneimine. The term "modification with a polyalkyleneimine" means that at least some of the amino groups of the polyalkyleneimine react with at least some of the acidic groups (mainly, carboxyl groups) originating from the resin material on the surfaces of the toner to form covalent bonds (amide bonds), or means that the amino groups of the polyalkyleneimine form ionic bonds with the acidic groups of the resin material.

A polyalkyleneimine has numerous amino groups. If a polyalkyleneimine adheres chemically to (combines with) the surfaces of the toner, numerous amino groups are present on the surfaces of the toner. The amino groups of the polyalkyleneimine attract the carbonyl groups at the acrylic polymer sites of the acrylic-polysiloxane graft copolymer, thus allowing the acrylic-polysiloxane graft copolymer to be present closer to the surfaces of the toner. This provides particularly superior dispersion stability for the toner.

In addition, the polyalkyleneimine provides superior positive charging properties because the amino groups attract cations. The amino groups of the polyalkyleneimine and the carbonyl groups of the acrylic-polysiloxane graft copolymer are further polarized as they electrically attract each other, thus providing particularly superior positive charging properties for the toner.

In addition, if the carrier liquid contains a hydrogen-modified silicone compound, the amino groups efficiently attract protons originating from the hydrogen-modified silicone compound, thus further improving the positive charging properties of the toner.

In addition, the polyalkyleneimine does not easily come off from the surfaces of the toner because it adheres chemically to the surfaces of the toner. This provides superior positive charging properties for the toner over an extended period of time and allows the toner to be stably dispersed in the carrier liquid over an extended period of time.

Examples of the polyalkyleneimine used include polyethyleneimine, polypropyleneimine, polybutyleneimine, and polyisopropyleneimine. Among others, polyethyleneimine is preferably used. This facilitates the modification of the surfaces of the toner, thus providing further superior long-term dispersion stability and positive charging properties for the toner.

The polyalkyleneimine preferably has a weight average molecular weight of 10,000 to 70,000. If the weight average molecular weight of the polyalkyleneimine falls within the above range, the surfaces of the toner can be more effectively modified (chemically modified). In addition, aggregation of the toner can be effectively prevented by steric hindrance of relatively long molecular chains of the polyalkyleneimine, thus effectively improving the dispersion stability of the toner.

4. Silicone Resin

The toner preferably contain a silicone resin.

A silicone resin has a high affinity with the acrylic-polysiloxane graft copolymer (particularly, with the polysiloxane moieties) and therefore allows a relatively large amount of acrylic-polysiloxane graft copolymer to adhere to the surfaces of the toner. This provides particularly superior dispersion stability for the toner. In addition, if the carrier liquid, described later, contains a silicone oil, the toner has a higher affinity with the carrier liquid because it contains a silicone resin, thus providing further superior dispersion stability for the toner in the liquid developer.

Examples of the silicone resin used include, but are not limited to, dimethyl silicones, epoxy-containing silicones, mercapto-containing silicones, and MQ resins.

Among others, as the silicone resin, the toner preferably contain a silicone resin (MQ resin) having partial structures represented by unit formulas (1) and (2):

$$R^1R^2R^3SiO_{1/2} \quad (1)$$

(where $R^1$, $R^2$, and $R^3$ are each independently a monovalent hydrocarbon group)

$$SiO_{4/2} \quad (2)$$

An MQ resin does not easily dissolve into the carrier liquid in the liquid developer and has a high affinity with the acrylic-polysiloxane graft copolymer and the carrier liquid. Accordingly, if the toner contain an MQ resin, it provides particularly superior dispersion stability for the toner over an extended period of time.

The silicone compound may be any compound having the partial structures represented by unit formulas (1) and (2) above. Although the silicone compound may have a partial structure other than the partial structures represented by unit formulas (1) and (2) above (hereinafter referred to as "other partial structure"), the silicone compound is preferably composed of the partial structures represented by unit formulas (1) and (2) above. If the silicone compound has another partial structure, the proportion of the other partial structure in the silicone compound is preferably 10% by weight or less, more preferably 5% by weight or less, on a composition formula basis.

In addition, the silicone is preferably present close to the surfaces of the toner. In this case, the toner have a higher affinity with the acrylic-polysiloxane graft copolymer and a silicone oil serving as the carrier liquid. This provides particularly superior dispersion stability for the toner in the liquid developer.

For example, to allow the silicone resin to be present close to the surfaces of the toner, surfaces of parent toner, described later, may be modified with the silicone resin by mixing them in an aqueous dispersion.

5. Other Components

In addition, the toner may contain components other than the above components. Examples of such components include a known wax and a magnetic powder.

In addition, other examples of constituent materials (components) of the toner include zinc stearate, zinc oxide, cerium oxide, silica, titanium oxide, iron oxide, fatty acids, and fatty acid metal salts.

Shape of Toner

The toner, formed of the materials described above, preferably have an average particle size of 0.5 to 5 μm, more preferably 1 to 4 μm, and most preferably 1 to 3.5 μm. If the average particle size of the toner falls with the above range, the toner vary little in properties. As a result, a toner image with sufficiently high resolution can be formed using the liquid developer while the liquid developer is reliable as a whole. In addition, the toner can be well dispersed in the carrier liquid so that the liquid developer has high storage stability. The term "average particle size" as used herein refers to a volume-based average particle size.

The content of the toner in the liquid developer is preferably 10% to 60% by weight, more preferably 20% to 50% by weight.

Carrier Liquid

Next, the carrier liquid will be described.

The carrier liquid functions as a dispersion medium in which the toner described above are dispersed.

In addition, the carrier liquid has high insulation so that charged toner can be transferred during image formation.

The carrier liquid may be any liquid having sufficiently high insulation. Specifically, the carrier liquid preferably has an electrical resistance at room temperature (20° C.) of $1\times10^9$ Ωcm or more, more preferably $1\times10^{11}$ Ωcm, and most preferably $1\times10^{13}$ Ωcm or more.

In addition, the carrier liquid preferably has a relative dielectric constant of 3.5 or less. Examples of the carrier liquid include dimethyl silicone oils such as KF-99, KF-96, KF-995 (manufactured by Shin-Etsu Chemical Co., Ltd.), AK35, AK50, AK100, AK350, AK1000 (manufactured by Wacker Chemie AG), SH200, SH510, and SH8400 (manufactured by Dow Corning Toray Co., Ltd.); silicone oils having a degree of polymerization of more than 20, including hydrogen-modified silicone compounds; low-molecular-weight siloxane compounds having a degree of polymerization of 20 or less, including cyclic siloxane compounds, such as cyclopentasiloxane and decamethylcyclopentasiloxane, and methyltris(trimethylsiloxy)silane; mineral oils (liquid hydrocarbons) such as Isopar E, Isopar G, Isopar H, Isopar L ("Isopar" is a trade name of ExxonMobil Chemical Company), Shellsol 70, Shellsol 71 ("Shellsol" is a trade name of Shell Chemicals), Amsco OMS, Amsco 460 solvent ("Amsco" is a trade name of American Mineral Spirits Company), and low- and high-viscosity liquid paraffins (such as those manufactured by Wako Pure Chemical Industries, Ltd.); fatty acid esters, such as fatty acid glycerides, fatty acid monoesters, and medium-chain fatty acid esters, and vegetable oils containing such fatty acid esters; and other compounds such as octane, isooctane, decane, isodecane, decalin, nonane, dodecane, isododecane, cyclohexane, cyclooctane, cyclodecane, benzene, toluene, xylene, mesitylene, butyl acetate, and isopropanol, and they can be used alone or in a combination of two or more.

Of the above compounds, the carrier liquid preferably contains at least one of a silicone oil and a low-molecular-weight siloxane compound. In this case, the carrier liquid has a high affinity with the acrylic-polysiloxane graft copolymer, thus allowing the toner to be more stably dispersed in the carrier liquid.

In addition, the low-molecular-weight siloxane compound used is preferably a cyclic siloxane compound and is more preferably cyclopentasiloxane or decamethylcyclopentasiloxane. If the carrier liquid contains such a compound, it provides particularly superior dispersion stability for the toner in the liquid developer.

If the carrier liquid contains a silicone oil containing a hydrogen-modified silicone compound, the following effect can be achieved. A hydrogen-modified silicone compound has hydrogen atoms at some of the side chains or terminals of the polysiloxane thereof. Some of these hydrogen atoms are liberated as hydrogen ions (protons) and are attracted by the functional groups (acidic groups) of the resin material present on the surfaces of the toner. As a result, the toner exhibit superior positive charging properties, thus providing superior development efficiency and transfer efficiency.

In addition, the hydrogen ions liberated from the hydrogen-modified silicone compound generally volatilizes easily as hydrogen molecules from the liquid developer. As a result, the hydrogen-modified silicone compound experiences a decrease in molecular weight and a chemical degradation. This varies the properties of the carrier liquid, thus undesirably degrading the dispersion stability and charging properties of the toner in the liquid developer. According to this embodiment, in contrast, the acrylic polymer moieties in the acrylic-polysiloxane graft copolymer trap the hydrogen ions to prevent them from changing to hydrogen molecules. Accordingly, the liquid developer varies little in properties even if it contains a hydrogen-modified silicone compound, thus maintaining superior dispersion stability and charging properties of the toner over an extended period of time.

The phrase "a hydrogen-modified silicone compound has hydrogen atoms at some of the side chains or terminals" herein means that a hydrogen-modified silicone compound has hydrogen atoms directly bonded to silicon atoms in the polysiloxane backbone thereof.

Examples of hydrogen-modified silicone compounds include poly(methyl hydrogen siloxane), poly(ethyl hydrogen siloxane), and poly(phenyl hydrogen siloxane).

The polysiloxane backbone of the hydrogen-modified silicone compound may be either branched or linear.

As described above, hydrogen atoms are bonded to the side chains or terminals of the polysiloxane backbone. If hydrogen atoms are bonded to the side chains, hydrogen ions can be easily released. This provides particularly superior positive charging properties for the toner. On the other hand, if hydrogen atoms are bonded to the terminals, hydrogen ions are relatively mildly released. This makes the hydrogen-modified silicone compound more resistant to deterioration so that the liquid developer varies little in properties over an extended period of time.

The hydrogen-modified silicone compound preferably has a dynamic viscosity at 25° C. of 20 to 500 $mm^2/s$, 20 to 80 $mm^2/s$, and most preferably 20 to 40 $mm^2/s$. This provides further superior dispersibility for the toner while ensuring superior positive charging properties.

In addition, the liquid developer (carrier liquid) may contain components other than the above components, including a known antioxidant and a known charge control agent.

The viscosity of the carrier liquid is preferably, but is not limited to, 5 to 1,000 mPa·s, more preferably 50 to 800 mPa·s, and most preferably 50 to 500 mPa·s. If the viscosity of the carrier liquid falls within the above range, the liquid developer can be supplied from a developer container onto an application roller with an appropriate amount of carrier liquid adhering to the toner, thus providing particularly superior toner image development properties and transfer properties. In addition, the dispersibility of the toner can be improved, the liquid developer can be more evenly supplied to an application roller in an image-forming apparatus as described later, and the liquid developer can be more effectively prevented from dripping from the application roller. In addition, the toner can be more effectively prevented from aggregating or settling, thus improving the dispersibility of the toner in the carrier liquid. In contrast, if the viscosity of the carrier liquid falls below the above lower limit, a problem may occur, such as dripping of the liquid developer from an application roller in an image-forming apparatus as described later. On the other hand, if the viscosity of the carrier liquid exceeds the above upper limit, the dispersibility of the toner cannot be sufficiently improved, and the liquid developer may be less evenly supplied to an application roller in an image-forming apparatus as described later. The term "viscosity" as used herein refers to a value measured at 25° C.

The liquid developer according to this embodiment may contain components other than the above components (such as a dispersant other than the acrylic-polysiloxane graft copolymer and additives).

Method for Producing Liquid Developer

Next, a method for producing the liquid developer described above according to a preferred embodiment of the invention will be described.

The method for producing the liquid developer according to this embodiment includes a resin-solution preparing step of preparing a resin solution by dissolving the resin material used for the toner described above in an organic solvent, an O/W-emulsion preparing step of preparing an O/W emulsion through the formation of a W/O emulsion by adding an aqueous liquid to the prepared resin solution, a coalescing step of coalescing dispersoids contained in the prepared O/W emulsion to form coalesced particles, an organic-solvent removing step of removing the organic solvent from the coalesced particles to form parent toner, a first surface-modifying step of modifying the surfaces of the parent toner with a polyalkyleneimine, a second surface-modifying step of further modifying the surfaces of the parent toner with a silicone resin to form toner, and a dispersion step of dispersing the toner in a carrier liquid containing an acrylic-polysiloxane graft copolymer.

The individual steps of the method for producing the liquid developer will now be described in detail.

Resin-Solution Preparing Step

First, a resin solution is prepared by dissolving the resin material in an organic solvent.

The prepared resin solution contains the resin material and the colorant for toner (materials other than the polyalkyleneimine and the silicone resin), as described above, and also contains an organic solvent, described below.

The organic solvent used may be any organic solvent that dissolves at least part of the resin material, although one having a lower boiling point than an aqueous liquid, described later, is preferably used. In this case, the organic solvent can be easily removed.

In addition, the organic solvent preferably has low compatibility with the aqueous liquid (aqueous dispersion medium) (for example, a solubility of 30 g or less in 100 g of aqueous liquid at 25°). In this case, dispersoids formed of the parent particle material can be stably microdispersed in an O/W emulsion (aqueous emulsion), described later.

The composition of the organic solvent can be appropriately selected depending on, for example, the compositions of the resin material, the colorant, and the aqueous liquid (aqueous dispersion medium).

The organic solvent is not particularly limited and may be, for example, a ketone solvent such as MEK or an aromatic hydrocarbon solvent such as toluene.

The resin solution can be prepared by, for example, mixing the resin material, the colorant, and the organic solvent using, for example, a mixer. Examples of mixers that can be used for preparation of the resin solution include high-speed mixers such as DESPA (manufactured by Asada Iron Works Co., Ltd.) and T.K. ROBOMIX/T.K. HOMO DISPER Model 2.5 (manufactured by PRIMIX Corporation).

The material temperature during the stirring is preferably 20° C. to 60° C., more preferably 30° C. to 50° C.

The solid content of the resin solution is preferably, but is not limited to, 40% to 75% by weight, more preferably 50% to 73% by weight, and most preferably 50% to 70% by weight. If the solid content falls within the above range, dispersoids having a higher sphericity (i.e., having a shape close to a perfect sphere) can be formed in a dispersion (aqueous dispersion), described later, and accordingly toner having an appropriate shape can be finally formed more reliably.

To prepare the resin solution, all the constituents of the resin solution to be prepared may be simultaneously mixed, or some of the constituents of the resin solution to be prepared may be mixed in advance to form a mixture (masterbatch) before the mixture (masterbatch) is mixed with the other constituents.

In the resin solution, some materials, such as the colorant, may remain undissolved in the organic solvent and be dispersed in the organic solvent.

O/W-Emulsion Preparing Step

Next, an O/W emulsion is prepared through the formation of a W/O emulsion by adding an aqueous liquid to the resin solution.

The aqueous liquid used may be a liquid composed mainly of water.

The aqueous liquid may contain, for example, a solvent highly compatible with water (for example, a solvent having a solubility of 50 parts by weight or more in 100 parts by weight of water at 25° C.)

In addition, an emulsifier may be added to the aqueous liquid as needed. By adding an emulsifier, the aqueous emulsion can be more easily prepared. The emulsifier used is not particularly limited and may be, for example, a known emulsifier.

In addition, the O/W emulsion may be prepared using, for example, a basic material. This allows, for example, the functional groups of the resin material (such as carboxyl groups) to be neutralized, thus providing particularly superior shape and dimensional uniformity and dispersibility for the dispersoids in the prepared O/W emulsion. As a result, the toner have a particularly sharp particle size distribution. The basic material may be added, for example, to the resin solution or to the aqueous liquid. In addition, the basic material may be added stepwise during the preparation of the O/W emulsion.

Examples of basic materials include sodium hydroxide, potassium hydroxide, and ammonia, and they can be used alone or in a combination of two or more.

In addition, the amount of basic material used is preferably one to three times the amount required for neutralizing all carboxyl groups of the resin material (i.e. one to three equivalents), more preferably one to two times the amount required for neutralizing all carboxyl groups of the resin material (i.e. one to two equivalents). This effectively prevents formation of irregular dispersoids and also provides a sharper particle size distribution in the coalescing step, described in detail later.

The aqueous liquid may be added to the resin solution by any method, although the aqueous liquid is preferably added to the resin solution while stirring the resin solution. That is, preferably, the aqueous liquid is gradually added (dropped) to the resin solution while applying shear to the resin solution using, for example, a mixer to convert a W/O emulsion into an O/W emulsion. This provides particularly superior dimensional and shape uniformity for the dispersoids contained in the O/W emulsion. As a result, the toner contained in the liquid developer finally obtained have a particularly sharp particle size distribution, thus varying little in properties.

Examples of mixers that can be used for preparation of the O/W emulsion include high-speed mixers or high-speed dispersers such as DESPA (manufactured by Asada Iron Works Co., Ltd.), T.K. ROBOMIX/T.K. HOMO DISPER Model 2.5 (manufactured by PRIMIX Corporation), Slasher (manufactured by Mitsui Mining Co., Ltd.), and CAVITRON (manufactured by Eurotec, Ltd.).

In addition, the aqueous liquid is preferably added to the resin solution with stirring at an impeller tip speed of 10 to 20 m/s, more preferably 12 to 18 m/s. If the impeller tip speed falls within the above range, the O/W emulsion can be efficiently prepared, and the dispersoids contained in the O/W emulsion vary little in shape and size. This provides particularly superior uniform dispersibility for the dispersoids while preventing formation of excessively fine dispersoids or coarse particles.

The solid content of the O/W emulsion is preferably, but is not limited to, 5% to 55% by weight, more preferably 10% to 50% by weight. This provides particularly superior productivity for the liquid developer while more reliably preventing unwanted aggregation of the dispersoids in the O/W emulsion.

The material temperature during this step is preferably 20° C. to 60° C., more preferably 20° C. to 50° C.

Coalescing Step

Next, the dispersoids are coalesced to form coalesced particles. The coalescence of the dispersoids normally proceeds such that the dispersoids containing the organic solvent collide with and combine with each other.

The dispersoids are coalesced by adding an electrolyte to the O/W emulsion while stirring the O/W emulsion. Thus, the coalesced particles can be easily and reliably formed. In addition, the particle size and particle size distribution of the coalesced particles can be easily and reliably controlled by adjusting the amount of electrolyte added.

Examples of electrolytes include, but are not limited to, known organic and inorganic water-soluble salts, and they can be used alone or in a combination of two or more.

In particular, the electrolyte is preferably a salt of a monovalent cation. In this case, the resultant coalesced particles have a particularly sharp particle size distribution. In addition, the use of a salt of a monovalent cation reliably prevents formation of coarse particles in this step.

Of the above compounds, the electrolyte is preferably a sulfate salt (such as sodium sulfate or ammonium sulfate) or a carbonate salt and is particularly preferably a sulfate salt. In this case, the particle size of the coalesced particles particularly can be easily controlled.

The amount of electrolyte added in this step is preferably 0.5 to 3 parts by weight, more preferably 1 to 2 parts by weight, on the basis of 100 parts by weight of the solid contained in the O/W emulsion to which the electrolyte is added. In this case, the particle size of the coalesced particles can be particularly easily and reliably controlled, and formation of coarse particles can be reliably prevented.

In addition, the electrolyte is preferably added in the form of an aqueous solution. In this case, the electrolyte can be quickly diffused through the entire O/W emulsion, and the amount of electrolyte added can be easily and reliably controlled. As a result, coalesced particles having a particularly sharp particle size distribution can be formed with a desired particle size.

In addition, if the electrolyte is added in the form of an aqueous solution, the concentration of the electrolyte in the aqueous solution is preferably 2% to 10% by weight, more preferably 2.5% to 6% by weight. In this case, the electrolyte can be particularly quickly diffused through the entire O/W emulsion, and the amount of electrolyte added can be easily and reliably controlled. In addition, if such an aqueous solution is added, the O/W emulsion has an appropriate water content upon completion of the addition of the electrolyte. Thus, the growth speed of the coalesced particles after the addition of the electrolyte can be mildly reduced without impairing productivity. As a result, the particle size can be more reliably controlled. In addition, unwanted coalescence of coalesced particles can be reliably prevented.

In addition, if the electrolyte is added in the form of an aqueous solution, the aqueous electrolytic solution is preferably added at a rate of 0.5 to 10 parts by weight per minute, more preferably 1.5 to 5 parts by weight per minute, on the basis of 100 parts by weight of the solid contained in the O/W emulsion to which the aqueous electrolytic solution is added. This avoids unevenness in the concentration of the electrolyte in the O/W emulsion, thus reliably preventing formation of coarse particles. In addition, the coalesced particles have a sharper particle size distribution. Furthermore, by adding the electrolyte at such a rate, the coalescence speed can be particularly easily controlled. Accordingly, the average particle size of the coalesced particles can be particularly easily controlled, and the liquid developer has particularly superior productivity.

The electrolyte may be added stepwise. In this case, coalesced particles having a desired size can be easily and reliably formed, and the sphericity of the coalesced particles can be reliably and sufficiently increased.

In addition, this step is carried out while stirring the O/W emulsion. In this case, coalesced particles varying little in shape and size can be formed.

The O/W emulsion can be stirred using a stirring impeller such as an anchor impeller, a turbine impeller, a Pfaudler impeller, a full-zone impeller, a Maxblend impeller, or a half-moon impeller. Of these, a Maxblend impeller and a full-zone impeller are preferred. In this case, the added electrolyte can be quickly and evenly dispersed and dissolved, thus reliably avoiding unevenness in the concentration of the electrolyte. In addition, the dispersoids can be efficiently coalesced while more reliably preventing the coalesced particles from collapsing. As a result, coalesced particles varying little in shape and size can be efficiently formed.

The impeller tip speed of the stirring impeller is 0.1 to 10 m/s, more preferably 0.2 to 8 m/s, and most preferably 0.2 to 6 m/s. If the impeller tip speed falls within the above range, the added electrolyte can be evenly dispersed and dissolved, thus reliably avoiding unevenness in the concentration of the electrolyte. In addition, the dispersoids can be efficiently coalesced while still more reliably preventing the coalesced particles from collapsing.

The average particle size of the resultant coalesced particles is preferably 0.5 to 5 μm, more preferably 1.5 to 3 μm. In this case, toner having an appropriate particle size can be finally formed more reliably.

Organic-Solvent Removing Step

Subsequently, the organic solvent is removed from the O/W emulsion (particularly, from the dispersoids). Thus, a dispersion (aqueous dispersion) having parent toner dispersed in an aqueous dispersion medium is obtained.

The organic solvent may be removed by any method. For example, the organic solvent can be removed under reduced pressure. In this case, the organic solvent can be efficiently removed while preventing, for example, deterioration of the constituent materials such as the resin material.

In addition, the treatment temperature during this step is preferably lower than the glass transition point (Tg) of the resin material used for the coalesced particles.

In addition, this step may be carried out after adding a defoamer to the O/W emulsion (dispersion). In this case, the organic solvent can be efficiently removed.

Examples of defoamers include mineral oil defoamers, polyether defoamers, silicone defoamers, lower alcohols, higher alcohols, oils and fats, fatty acids, fatty acid esters, and phosphate esters.

The amount of defoamer used is preferably, but is not limited to, 20 to 300 ppm by weight, more preferably 30 to 100 ppm by weight, on the basis of the solid content of the O/W emulsion.

In this step, additionally, at least part of the aqueous liquid may be removed together with the organic solvent.

In this step, additionally, it is unnecessary to remove all organic solvent (all organic solvent contained in the dispersion) because residual organic solvent can be sufficiently removed in the step described below.

Cleaning Step (First Cleaning Step)

Next, the parent toner obtained as described above are cleaned. Thus, a dispersion (aqueous dispersion) containing cleaned parent toner can be obtained.

By carrying out this step, impurities such as the organic solvent can be efficiently removed. By carrying out this step, additionally, the electrolyte, the basic material, and the acidic material used in the above steps and salts produced by acid-base reaction can be efficiently removed. As a result, the parent toner finally obtained have particularly low TVOC (total volatile organic compounds). In addition, the carrier liquid has particularly high electrical resistance, and the parent toner have improved stability of properties.

This step can be carried out by, for example, separating the parent toner by solid-liquid separation (separation from the aqueous liquid) and then redispersing the solid (parent toner) in the aqueous liquid (aqueous dispersion medium). The solid-liquid separation and the redispersion of the solid in the aqueous liquid may be repeated multiple times. The cleaning is preferably carried out until a supernatant liquid taken from the dispersion (slurry) having the solid (parent toner) redispersed in the aqueous liquid (aqueous dispersion medium) has a conductivity of 20 μS/cm or less.

First Surface-Modifying Step

Next, the above dispersion (aqueous dispersion) containing the parent toner is mixed with a polyalkyleneimine to modify the surfaces of the parent toner with the polyalkyleneimine.

This step may be carried out simply by mixing the aqueous dispersion with the polyalkyleneimine, although it is preferably carried out after adjusting the hydrogen ion exponent (pH) of the dispersion (aqueous dispersion) to 2 to 8. This allows the reaction between the acidic groups present on the surfaces of the toner and the polyalkyleneimine to proceed more efficiently so that the polyalkyleneimine combines more firmly with the surfaces of the parent toner while reliably avoiding, for example, unwanted deterioration of the constituent materials of the parent toner. As a result, the parent toner have particularly superior long-term dispersion stability and stability of charging properties. Although the hydrogen ion exponent (pH) of the dispersion (aqueous dispersion) in this step is preferably 2 to 8, as described above, it is more preferably 2.5 to 6.5 and most preferably 4 to 5. In this case, the above effect appears more significantly.

The pH of the dispersion can be adjusted by, for example, adding 1 N hydrochloric acid.

In addition, after the dispersion is mixed with the polyalkyleneimine, the mixture is preferably stirred for one to three hours. This allows the surfaces of the parent toner to be more evenly modified (chemically modified).

In addition, the mixture may be stirred either at room temperature or while being heated to 30° C. to 40° C. By heating, the surfaces of the parent toner can be more efficiently modified (chemically modified).

The amount of polyalkyleneimine used in this step is preferably 0.02 to 2.0 parts by weight, more preferably 0.06 to 1.2 parts by weight, and most preferably 0.1 to 0.6 parts by weight, on the basis of 100 parts by weight of the resin material. In particular, if the resin material contains a rosin resin, the amount of polyalkyleneimine used in this step is preferably 0.1 to 10 parts by weight, more preferably 0.3 to 6.0 parts by weight, and most preferably 0.5 to 3.0 parts by weight, on the basis of 100 parts by weight of the rosin resin.

If the amount of polyalkyleneimine used falls within the above range, it is possible to provide particularly superior long-term dispersion stability and positive charging properties for the toner while reliably preventing problems such as dissolution of excess polyalkyleneimine in the carrier liquid in the liquid developer finally obtained.

Cleaning Step (Second Cleaning Step)

Next, the parent toner obtained as described above are cleaned. Thus, a dispersion (aqueous dispersion) containing cleaned parent toner can be obtained.

By carrying out this step, excess polyalkyleneimine and electrolyte used in the above steps, salts produced by acid-base reaction, and other impurities can be efficiently removed. As a result, in the liquid developer finally obtained, the carrier liquid has particularly high electrical resistance, and the toner have improved stability of properties.

This step can be carried out by, for example, separating the parent toner by solid-liquid separation (separation from the aqueous liquid) and then redispersing the solid (parent toner) in the aqueous liquid (aqueous dispersion medium). The solid-liquid separation and the redispersion of the solid in the aqueous liquid may be repeated multiple times. The cleaning is preferably carried out until a supernatant liquid taken from the dispersion (slurry) having the solid (parent toner) redispersed in the aqueous liquid (aqueous dispersion medium) has a conductivity of 20 μS/cm or less.

The polyalkyleneimine, as described above, combines firmly with the toner containing the rosin resin. Thus, unlike dispersants used for known liquid developers, the polyalkyleneimine is reliably prevented from coming off from the toner during the cleaning.

Second Surface-Modifying Step

Next, the above dispersion (aqueous dispersion) containing the parent toner is mixed with a silicone resin to modify the surfaces of the parent toner with the silicone resin.

This step may be carried out simply by mixing the aqueous dispersion with the silicone resin, although it is preferably carried out after adjusting the hydrogen ion exponent (pH) of the dispersion (aqueous dispersion) to 8 to 13. This allows a sufficient amount of silicone resin to adhere to the surfaces of the parent toner while reliably avoiding, for example, unwanted deterioration of the constituent materials of the parent toner. Although the hydrogen ion exponent (pH) of the dispersion (aqueous dispersion) in this step is preferably 8 to 13, as described above, it is more preferably 8 to 12 and most preferably 9 to 10. In this case, the above effect appears more significantly.

After the first surface-modifying step and the second cleaning step, the aqueous dispersion normally has a pH of 9 to 10. If the pH is beyond this range, it may be adjusted by adding, for example, a basic material or an acidic material.

In addition, the silicone resin is preferably added to the aqueous dispersion in the form of an emulsion (silicone emulsion). If the silicone emulsion is added to the aqueous dispersion, silicone resin particles are well dispersed in the aqueous dispersion, thus easily adhering to the toner.

In this case, the silicone emulsion is preferably prepared using an anionic surfactant. This allows the amino groups (base) of the polyalkyleneimine and the anionic surfactant (acid) to undergo an acid-base reaction so that the silicone emulsion (silicone resin) adheres well to the parent toner.

Examples of commercially available anionic silicone emulsions include KM-9719 (manufactured by Shin-Etsu Chemical Co., Ltd.), Polon MNST (manufactured by Shin-Etsu Chemical Co., Ltd.), KM-9737 (manufactured by Shin-Etsu Chemical Co., Ltd.), KM-9738 (manufactured by Shin-Etsu Chemical Co., Ltd.), Polon MF-32 (manufactured by Shin-Etsu Chemical Co., Ltd.), X-52-8001 (manufactured by Shin-Etsu Chemical Co., Ltd.), X-51-1264 (manufactured by Shin-Etsu Chemical Co., Ltd.), and X-51-1302M (manufactured by Shin-Etsu Chemical Co., Ltd.). Among others, the anionic silicone emulsion used is preferably KM-9719 (manufactured by Shin-Etsu Chemical Co., Ltd.).

In addition, after the dispersion is mixed with the silicone resin (or silicone emulsion), the mixture is preferably stirred for one to three hours. In this case, the surfaces of the parent toner can be more evenly modified (chemically modified).

In addition, the mixture may be stirred either at room temperature or while being heated to 30° C. to 40° C.

The amount of silicone resin used in this step is preferably 0.04 to 5.0 parts by weight, more preferably 0.12 to 2.4 parts by weight, and most preferably 0.2 to 1.2 parts by weight, on the basis of 100 parts by weight of the resin material. If the amount of silicone resin used falls within the above range, it is possible to provide particularly superior long-term dispersion stability and positive charging properties for the toner while avoiding an adverse effect on the charging properties of the toner due to adhesion of excess silicone resin to the surfaces of the toner in the carrier liquid in the liquid developer finally obtained.

Cleaning Step (Third Cleaning Step)

Next, the parent toner obtained as described above are cleaned. Thus, a dispersion (aqueous dispersion) containing cleaned parent toner can be obtained.

By carrying out this step, excess silicone emulsion used in the above step and other impurities can be efficiently removed. As a result, the carrier liquid has particularly high electrical resistance, and the toner have improved stability of properties.

The silicone resin, being hydrophobic, does not easily come off from the parent toner during this step.

This step can be carried out by, for example, separating the parent toner by solid-liquid separation (separation from the aqueous liquid) and then redispersing the solid (parent toner) in the aqueous liquid (aqueous dispersion medium). The solid-liquid separation and the redispersion of the solid in the aqueous liquid may be repeated multiple times.

Drying Step

Subsequently, drying is performed, so that toner are obtained. By this step, the content of water in the toner can be reliably and sufficiently reduced, thus providing particularly superior storage stability and stability of properties for the liquid developer finally obtained.

The drying step may be carried out using, for example, a vacuum dryer (such as RIBOCONE (manufactured by Okawara Corporation) or a Nauta dryer (such as the one manufactured by Hosokawa Micron Corporation)) or a fluidized-bed dryer (such as the one manufactured by Okawara Corporation).

Dispersion Step

Next, the toner obtained as described above are dispersed in a carrier liquid containing an acrylic-polysiloxane graft copolymer. Thus, a liquid developer is obtained.

The toner may be dispersed in the carrier liquid by any method, for example, by mixing the carrier liquid and the toner using a bead mill or a ball mill.

In addition, components other than the carrier liquid, the acrylic-polysiloxane graft copolymer, and the toner may be mixed during the dispersion.

In addition, the dispersion of the toner in the carrier liquid may be performed using all carrier liquid used for the liquid developer finally obtained or using a portion of the carrier liquid.

The liquid developer produced by the method described above varies little in the shape and properties of the toner. In addition, the acrylic-polysiloxane graft copolymer contained in the liquid developer provides superior dispersion stability for the toner.

Image-Forming Apparatus

Next, an image-forming apparatus according to a preferred embodiment of the invention will be described.

Figure 2:
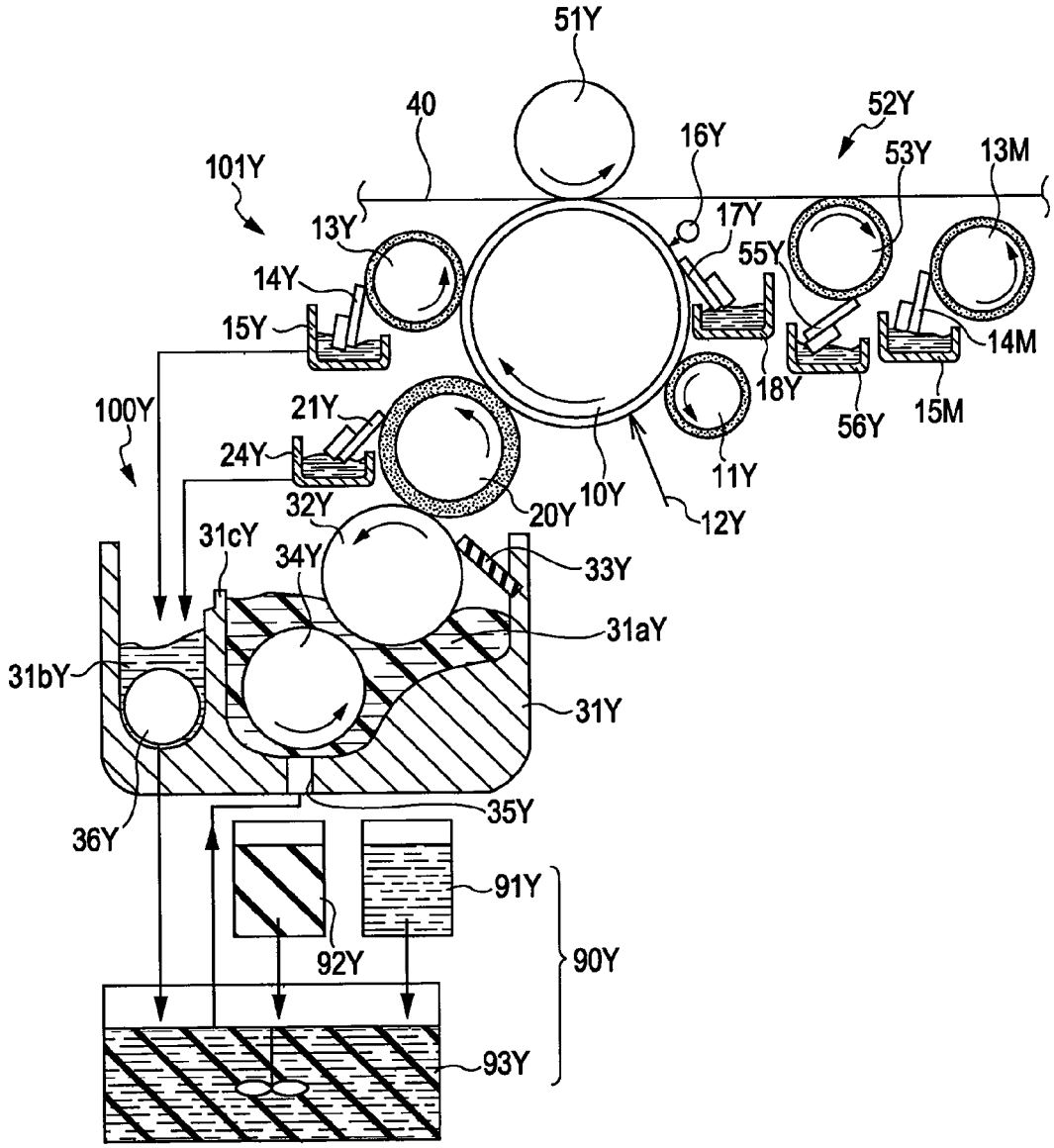
FIG. 2 is a partial enlarged view of the image-forming apparatus shown in FIG. 1.

FIG. 1 is a schematic diagram of the image-forming apparatus according to the preferred embodiment of the invention, and FIG. 2 is a partial enlarged view of the image-forming apparatus shown in FIG. 1.

Referring to FIGS. 1 and 2, an image-forming apparatus 1000 includes four developing sections 30Y, 30M, 30C, and 30K, a transfer section (intermediate transfer member 40 and secondary transfer unit (secondary transfer section) 60), a fusing section (fusing unit) F40, and four liquid developer supply sections 90Y, 90M, 90C, and 90K.

The developing sections 30Y, 30M, and 30C have the function of developing latent images with a yellow liquid developer (Y), a magenta liquid developer (M), and a cyan liquid developer (C), respectively, to form monochrome images of the individual colors. In addition, the developing section 30K has the function of developing a latent image with a black liquid developer (K) to form a black monochrome image.

The developing sections 30Y, 30M, 30C, and 30K have the same configuration, and the developing section 30Y will therefore be described below.

As shown in FIG. 2, the developing section 30Y includes a photoreceptor 10Y, serving as an example of an image carrier, and, in order of the rotational direction of the photoreceptor 10Y, a charge roller 11Y, an exposure unit 12Y, a developing unit 100Y, a photoreceptor squeeze unit 101Y, a primary transfer backup roller 51Y, a neutralizing unit 16Y, a photoreceptor cleaning blade 17Y, and a developer collector 18Y.

The photoreceptor 10Y includes a cylindrical substrate and a photoreceptor layer disposed on the circumferential surface thereof and formed of a material such as amorphous silicon, and is rotatable about the central axis thereof. In this embodiment, the photoreceptor 10Y rotates clockwise, as indicated by the arrow in FIG. 2.

The photoreceptor 10Y is supplied with a liquid developer from the developing unit 100Y, described later, so that a layer of the liquid developer is formed on the surface of the photoreceptor 10Y.

The charge roller 11Y is a unit for charging the photoreceptor 10Y. The exposure unit 12Y is a unit for irradiating the charged photoreceptor 10Y with a laser beam to form a latent image. The exposure unit 12Y includes, for example, a semiconductor laser, a polygon mirror, and an f-θ lens and irradiates the charged photoreceptor 10Y with a laser beam modulated on the basis of an image signal input from a host computer (not shown) such as a personal computer or a word processor.

The developing unit 100Y is a unit for developing the latent image formed on the photoreceptor 10Y using a liquid developer according to the invention. The developing unit 100Y will be described in detail later.

The photoreceptor squeeze unit 101Y is disposed opposite the photoreceptor 10Y downstream of the developing unit 100Y in the rotational direction and includes a photoreceptor squeeze roller 13Y, a cleaning blade 14Y for removing the liquid developer from the surface of the photoreceptor squeeze roller 13Y by sliding thereover with pressure, and a developer collector 15Y for collecting the removed liquid developer. The photoreceptor squeeze unit 101Y has the function of collecting excess carrier (carrier liquid) and unwanted fog toner from the developer deposited on the photoreceptor 10Y to increase the proportion of toner in the visible image.

The primary transfer backup roller 51Y is a unit for transferring the monochrome image formed on the photoreceptor 10Y onto the intermediate transfer member 40, described later.

The neutralizing unit 16Y is a unit for removing residual charge from the photoreceptor 10Y after the primary transfer backup roller 51Y transfers the intermediate transfer image onto the intermediate transfer member 40.

The photoreceptor cleaning blade 17Y is a rubber member abutting the surface of the photoreceptor 10Y and has the function of scraping residual liquid developer off the photoreceptor 10Y after the primary transfer backup roller 51Y transfers the image onto the intermediate transfer member 40.

The developer collector 18Y has the function of collecting the liquid developer scraped off by the photoreceptor cleaning blade 17Y.

The intermediate transfer member 40 is an endless elastic belt member running around a belt drive roller 41 to which a driving force from a motor (not shown) is transmitted and a pair of driven rollers 44 and 45. The intermediate transfer member 40 is rotated counterclockwise by the belt drive roller 41 while abutting the photoreceptors 10Y, 10M, 10C, and 10K at the primary transfer backup rollers 51Y, 51M, 51C, and 51K, respectively.

In addition, a tension roller 49 applies a predetermined tension to the intermediate transfer member 40 to take up a slack therein. The tension roller 49 is disposed downstream of one driven roller 44 in the rotational (movement) direction of the intermediate transfer member 40 and upstream of the other driven roller 45 in the rotational (movement) direction of the intermediate transfer member 40.

The monochrome images of the individual colors formed by the developing sections 30Y, 30M, 30C, and 30K are sequentially transferred onto the intermediate transfer member 40 by the primary transfer backup rollers 51Y, 51M, 51C, and 51K so as to be superimposed on each other. Thus, a full-color developer image (intermediate transfer image) is formed on the intermediate transfer member 40.

In this way, the monochrome images formed on the photoreceptors 10Y, 10M, 10C, and 10K are sequentially transferred, superimposed, and carried by the intermediate transfer member 40. The monochrome images are then simultaneously secondarily transferred onto a recording medium F5 such as paper, film, or cloth by the secondary transfer unit 60, described later. Accordingly, an elastic belt member is used as the intermediate transfer member 40 for improved secondary transfer properties so that the toner images can also be transferred onto the surface of a recording medium F5 formed of a rough sheet, such as a fibrous sheet, in the secondary transfer step.

In addition, the intermediate transfer member 40 is provided with a cleaning unit including an intermediate transfer member cleaning blade 46, a developer collector 47, and a noncontact biasing member 48.

The intermediate transfer member cleaning blade 46 and the developer collector 47 are disposed opposite the driven roller 45.

The intermediate transfer member cleaning blade 46 has the function of scraping residual liquid developer off the intermediate transfer member 40 after the secondary transfer unit (secondary transfer section) 60 transfers the toner image onto the recording medium F5.

The developer collector 47 has the function of collecting the liquid developer scraped off by the intermediate transfer member cleaning blade 46.

The noncontact biasing member 48 is disposed at a position opposite the tension roller 49 without contact with the intermediate transfer member 40. By the noncontact biasing member 48, a bias voltage opposite in polarity to the toner (solid) in the liquid developer remaining on the intermediate transfer member 40 after the secondary transfer is applied to the toner. This neutralizes the toner, thus reducing the electrostatic attraction force exerted on the toner by the intermediate transfer member 40. In this example, the noncontact biasing member 48 used is a corona charger.

The noncontact biasing member 48 does not necessarily have to be disposed at a position opposite the tension roller 49, but may be disposed at any position downstream of the driven roller 44 in the movement direction of the intermediate transfer member 40 and upstream of the driven roller 45 in the movement direction of the intermediate transfer member 40, for example, at a position between the driven roller 44 and the tension roller 49. In addition, the noncontact biasing member 48 used may be a known noncontact charger other than corona chargers.

In addition, an intermediate transfer member squeeze unit 52Y is disposed downstream of the primary transfer backup roller 51Y in the movement direction of the intermediate transfer member 40.

The intermediate transfer member squeeze unit 52Y is provided as a unit for removing excess carrier liquid from the liquid developer transferred onto the intermediate transfer member 40 if the transferred liquid developer is not in a desired dispersion condition.

The intermediate transfer member squeeze unit 52Y includes an intermediate transfer member squeeze roller 53Y, an intermediate transfer member squeeze cleaning blade 55Y for cleaning the surface of the intermediate transfer member squeeze roller 53Y by sliding thereover with pressure, and a developer collector 56Y for collecting the liquid developer removed by the intermediate transfer member squeeze cleaning blade 55Y.

The intermediate transfer member squeeze unit 52Y has the function of collecting excess carrier liquid from the developer primarily transferred onto the intermediate transfer member 40 to increase the proportion of toner in the image and also has the function of collecting unwanted fog toner.

The secondary transfer unit 60 includes a pair of secondary transfer rollers disposed at a predetermined interval from each other in the movement direction of the transfer material. Of the pair of secondary transfer rollers, the one disposed upstream in the movement direction of the intermediate transfer member 40 is an upstream secondary transfer roller 64. The upstream secondary transfer roller 64 can be pressed against the belt drive roller 41 with the intermediate transfer member 40 therebetween.

Of the pair of secondary transfer rollers, the one disposed downstream in the movement direction of the transfer material is a downstream secondary transfer roller 65. The downstream secondary transfer roller 65 can be pressed against the driven roller 44 with the intermediate transfer member 40 therebetween.

That is, the upstream secondary transfer roller 64 and the downstream secondary transfer roller 65 bring the recording medium F5 into contact with the intermediate transfer member 40 at the belt drive roller 41 and the driven roller 44, respectively, to secondarily transfer the intermediate transfer image, formed on the intermediate transfer member 40 by superimposing the images of different colors, onto the recording medium F5.

In this case, the belt drive roller 41 and the driven roller 44 also function as backup rollers for the upstream secondary transfer roller 64 and the downstream secondary transfer roller 65, respectively. That is, the belt drive roller 41 is also used as an upstream backup roller disposed upstream of the driven roller 44 in the movement direction of the recording medium F5 in the secondary transfer unit 60. On the other hand, the driven roller 44 is also used as a downstream backup roller disposed downstream of the belt drive roller 41 in the movement direction of the recording medium F5 in the secondary transfer unit 60.

Accordingly, the recording medium F5 transported to the secondary transfer unit 60 is brought into intimate contact with the intermediate transfer member 40 in a predetermined transfer material movement region from a pressing initiation position (nip initiation position) between the upstream secondary transfer roller 64 and the belt drive roller 41 to a pressing termination position (nip termination position) between the downstream secondary transfer roller 65 and the driven roller 44. This allows the full-color intermediate transfer image to be secondarily transferred from the intermediate transfer member 40 onto the recording medium F5 in intimate contact with the intermediate transfer member 40 over a predetermined period of time, thus enabling excellent secondary transfer.

In addition, the secondary transfer unit 60 includes a secondary transfer roller cleaning blade 66 and a developer collector 67 for the upstream secondary transfer roller 64. In addition, the secondary transfer unit 60 includes a secondary transfer roller cleaning blade 68 and a developer collector 69 for the downstream secondary transfer roller 65. The secondary transfer roller cleaning blades 66 and 68 abut the secondary transfer rollers 64 and 65, respectively, to scrape residual liquid developer off the surfaces of the secondary transfer rollers 64 and 65 after the secondary transfer. In addition, the developer collectors 67 and 69 collect and store the liquid developer scraped off the secondary transfer rollers 64 and 65 by the secondary transfer roller cleaning blades 66 and 68, respectively.

The toner image (transfer image) transferred onto the recording medium F5 by the secondary transfer unit 60 is transported to the fusing section (fusing unit) F40, which then fuses the image onto the recording medium F5 by heating and pressing.

Specifically, the fusion temperature (set temperature) is preferably 80° C. to 160° C., more preferably 100° C. to 150° C., and most preferably 100° C. to 140° C.

Next, the developing units 100Y, 100M, 100C, and 100K will be described in detail. In the description below, the developing unit 100Y will be described as a representative example.

As shown in FIG. 2, the developing unit 100Y includes a liquid developer reservoir 31Y, an application roller 32Y, a regulating blade 33Y, a developer stirring roller 34Y, a communication channel 35Y, a collecting screw 36Y, a developing roller 20Y, and a developing roller cleaning blade 21Y.

The liquid developer reservoir 31Y has the function of storing a liquid developer for developing a latent image formed on the photoreceptor 10Y and includes a supply portion 31*a*Y for supplying the liquid developer to the application roller 32Y, a collecting portion 31*b*Y for collecting excess liquid developer from, for example, the supply portion 31*a*Y, and a partition 31*c*Y separating the supply portion 31*a*Y and the collecting portion 31*b*Y.

The supply portion 31*a*Y has the function of supplying the liquid developer to the application roller 32Y and has a recess where the developer stirring roller 34Y is disposed. In addition, the supply portion 31*a*Y is supplied with the liquid developer from a liquid developer mixing vessel 93Y through the communication channel 35Y.

In addition, the collecting portion 31*b*Y collects excess liquid developer supplied into the supply portion 31*a*Y and excess liquid developer collected by the developer collectors 15Y and 24Y. The collected liquid developer is transported to the liquid developer mixing vessel 93Y, described later, for reuse. In addition, the collecting portion 31*b*Y has a recess having the collecting screw 36Y disposed near the bottom thereof.

In addition, because the liquid developer according to the invention has superior dispersion stability, the toner in the collected liquid developer are prevented from aggregating. Thus, the toner in the liquid developer collected in the collecting portion 31*b*Y can be easily dispersed even after the toner are charged or the solid content of the liquid developer varies during the development and transfer. That is, the liquid developer is easy to recycle.

The wall-shaped partition 31*c*Y is disposed at the boundary between the supply portion 31*a*Y and the collecting portion 31*b*Y. The partition 31*c*Y separates the supply portion 31*a*Y and the collecting portion 31*b*Y to prevent contamination of fresh liquid developer with the collected liquid developer. In addition, if excess liquid developer is supplied to the supply portion 31*a*Y, the excess liquid developer overflows from the supply portion 31*a*Y into the collecting portion 31*b*Y beyond the partition 31*c*Y. This maintains a constant level of liquid developer in the supply portion 31*a*Y and therefore maintains a constant amount of liquid developer supplied to the application roller 32Y. Accordingly, the image finally formed has stable image quality.

In addition, the partition 31*c*Y has a cutaway through which the liquid developer overflows from the supply portion 31*a*Y into the collecting portion 31*b*Y.

The application roller 32Y has the function of supplying the liquid developer to the developing roller 20Y.

The application roller 32Y is one called an anilox roller, that is, a metal roller, such as an iron roller, having grooves formed evenly and spirally on the surface thereof and plated with nickel, and has a diameter of about 25 mm. In this embodiment, the grooves are formed diagonally to the rotational direction of the application roller 32Y by, for example, cutting or form rolling. The application roller 32Y rotates counterclockwise while being in contact with the liquid developer to carry the liquid developer in the grooves thereof and transport it from the supply portion 31*a*Y to the developing roller 20Y.

The regulating blade 33Y abuts the surface of the application roller 32Y to regulate the amount of liquid developer on the application roller 32Y. That is, the regulating blade 33Y functions to scrape excess liquid developer off the application roller 32Y to determine the amount of liquid developer on the application roller 32Y to be supplied to the developing roller 20Y. The regulating blade 33Y is formed of a urethane rubber, serving as an elastomer, and is supported by a regulating blade support member formed of a metal such as iron. The regulating blade 33Y is disposed on the side where the application roller 32Y appears from the liquid developer as it rotates (that is, to the right in FIG. 2). The rubber of the regulating blade 33Y has a JIS-A hardness of about 77°. The hardness of the portion, abutting the surface of the application roller 32Y, of the regulating blade 33Y (about 77°) is lower than that of the portion, pressed against the surface of the application roller 32Y, of an elastic layer of the developing roller 20Y, described later (about 85°). The scraped excess liquid developer is collected by the supply portion 31*a*Y for reuse.

The developer stirring roller 34Y has the function of stirring the liquid developer to a uniformly dispersed state. This allows the toner to be well dispersed even after the toner are aggregated.

In the supply portion 31*a*Y, the toner in the liquid developer are positively charged, and the liquid developer is stirred to a uniformly dispersed state by the developer stirring roller 34Y. As the application roller 32Y rotates, the liquid developer is pumped from the liquid developer reservoir 31Y and is supplied to the developing roller 20Y after the amount of liquid developer is regulated by the regulating blade 33Y. In addition, the developer stirring roller 34Y stirs the liquid developer so that it can stably overflow into the collecting portion 31*b*Y beyond the partition 31*c*Y, thus preventing the liquid developer from being retained and compressed.

The developer stirring roller 34Y is disposed near the communication channel 35Y. Thus, the liquid developer supplied from the communication channel 35Y can be quickly diffused, and the liquid level in the supply portion 31*a*Y can be stabilized while the liquid developer is being supplied to the supply portion 31*a*Y. Being disposed near the communication channel 35Y, the developer stirring roller 34Y creates a negative pressure in the communication channel 35Y so that the liquid developer can be spontaneously pumped.

The communication channel 35Y is a channel provided vertically below the developer stirring roller 34Y so as to communicate with the liquid developer reservoir 31Y to pump the liquid developer from the liquid developer mixing vessel 93Y into the supply portion 31*a*Y.

Because the communication channel 35Y is provided below the developer stirring roller 34Y, the developer stirring roller 34Y stops the liquid developer supplied from the communication channel 35Y to maintain a substantially constant liquid level without a rise in liquid level due to ejection, thus stably supplying the developer to the application roller 32Y.

In addition, the collecting screw 36Y, disposed near the bottom of the collecting portion 31*b*Y, is a cylindrical member having a spiral rib on the circumferential surface thereof and functions to maintain the liquidity of the collected liquid developer and to facilitate transportation of the liquid developer to the liquid developer mixing vessel 93Y.

The developing roller 20Y carries the liquid developer and transports it to a development position opposite the photoreceptor 10Y to develop a latent image carried by the photoreceptor 10Y with the liquid developer.

The liquid developer is supplied from the application roller 32Y described above to the surface of the developing roller 20Y to form a layer of the liquid developer.

The developing roller 20Y includes an inner core formed of a metal such as iron and a conductive elastic layer formed on the circumferential surface thereof and has a diameter of about 20 mm. The elastic layer has a double-layer structure including an inner layer formed of a urethane rubber having a JIS-A hardness of about 30° and having a thickness of about 5 mm and a surface layer (outer layer) formed of a urethane rubber having a JIS-A hardness of about 85° and having a thickness of about 30 μm. The surface layer, serving as the portion of the developing roller 20Y to be pressed, is pressed against the application roller 32Y and the photoreceptor 10Y so as to be elastically deformed.

The developing roller 20Y is rotatable about the central axis thereof, the central axis being positioned below the central axis of rotation of the photoreceptor 10Y. The developing roller 20Y rotates in a direction (counterclockwise in FIG. 2) opposite to the rotational direction (clockwise in FIG. 2) of the photoreceptor 10Y. An electric field is generated between the developing roller 20Y and the photoreceptor 10Y to develop the latent image formed on the photoreceptor 10Y.

In the developing unit 100Y, the application roller 32Y and the developing roller 20Y are separately driven by different power sources (not shown). Accordingly, the amount of liquid developer supplied to the developing roller 20Y can be adjusted by changing the ratio between the rotational speeds (linear speeds) of the application roller 32Y and the developing roller 20Y.

In addition, the developing unit 100Y includes a rubber developing roller cleaning blade 21Y abutting the surface of the developing roller 20Y and a developer collector 24Y. The developing roller cleaning blade 21Y is a unit for scraping residual liquid developer off the developing roller 20Y after development at the development position. The developer collector 24Y collects the liquid developer scraped off by the developing roller cleaning blade 21Y.

As shown in FIGS. 1 and 2, additionally, the image-forming apparatus 1000 includes liquid developer supply sections 90Y, 90M, 90C, and 90K for supplying liquid developers to the developing sections 30Y, 30M, 30C, and 30K, respectively. The liquid developer supply sections 90Y, 90M, 90C, and 90K include, respectively, liquid developer tanks 91Y, 91M, 91C, and 91K, carrier liquid tanks 92Y, 92M, 92C, and 92K, and liquid developer mixing vessels 93Y, 93M, 93C, and 93K.

The liquid developer tanks 91Y, 91M, 91C, and 91K contain concentrated liquid developers corresponding to the individual colors. The carrier liquid tanks 92Y, 92M, 92C, and 92K contain carrier liquids. The liquid developer mixing vessels 93Y, 93M, 93C, and 93K are supplied with predetermined amounts of concentrated liquid developers from the liquid developer tanks 91Y, 91M, 91C, and 91K and are supplied with predetermined amounts of carrier liquids from the carrier liquid tanks 92Y, 92M, 92C, and 92K.

The liquid developer mixing vessels 93Y, 93M, 93C, and 93K mix and stir the supplied concentrated liquid developers and carrier liquids with built-in stirrers to prepare liquid developers, corresponding to the individual colors, to be used in the supply portions 31*a*Y, 31*a*M, 31*a*C, and 31*a*K. The liquid developers prepared in the liquid developer mixing vessels 93Y, 93M, 93C, and 93K are supplied to the supply portions 31*a*Y, 31*a*M, 31*a*C, and 31*a*K, respectively.

In addition, the liquid developer mixing vessels 93Y, 93M, 93C, and 93K collect the liquid developers collected by the collecting portions 31*b*Y, 31*b*M, 31*b*C, and 31*b*K, respectively, for reuse.

An image formation process using the above image-forming apparatus 1000 includes a development step of forming monochrome images of different colors on the photoreceptors 10Y, 10M, 10C, and 10K using liquid developers corresponding to the individual colors (liquid developers according to the invention), a transfer step of forming an unfused toner image by transferring the monochrome images from the photoreceptors 10Y, 10M, 10C, and 10K onto the recording medium F5 so that they are superimposed on the recording medium F5, and a fusing step of fusing the unfused toner image onto the recording medium F5. With this process, a vivid image can be easily formed.

Whereas the invention has been described above on the basis of preferred embodiments, the invention is not limited thereto.

For example, the liquid developer according to the invention is not limited to one applied to the image-forming apparatus as described above.

In addition, the liquid developer according to the invention is not limited to one produced by the method as described above.

In addition, although coalesced particles are formed by preparing an aqueous emulsion and adding an electrolyte to the aqueous emulsion in the embodiment described above, the invention is not limited thereto. For example, coalesced particles may be formed by emulsion aggregation, in which a colorant, a monomer, a surfactant, and a polymerization initiator are dispersed in an aqueous liquid to prepare an aqueous emulsion by emulsion polymerization and an electrolyte is then added to the aqueous emulsion to cause aggregation, or may be formed by subjecting the resultant aqueous emulsion to spray drying.

In addition, the toner used are not limited to those of the embodiment described above, and may instead be, for example, those prepared by kneading a resin material and a colorant and crushing the kneaded material.

EXAMPLES

1. Production of Liquid Developer

Liquid developers were produced as follows, where the individual steps were carried out at room temperature (25° C.) unless otherwise specified.

Example 1

Dispersion-Preparing Step (Aqueous-Dispersion Preparing Step)

Preparation of Colorant Masterbatch

First, 60 parts by weight of a polyester resin (acid value: 10 mg KOH/g; glass transition point (Tg): 55° C.; softening point: 107° C.) was prepared as a resin material.

Next, the above resin material was mixed with a cyan pigment (Pigment Blue 15:3, manufactured by Dainichiseika Color & Chemicals Mfg. Co., Ltd.), serving as a colorant, in a mass ratio of 50:50. These components were mixed using a 20 L Henschel mixer to prepare a raw material for production of toner.

Next, the raw material (mixture) was kneaded using a double-screw kneading and extruding machine. The kneaded material extruded from an extrusion port of the double-screw kneading and extruding machine was cooled.

The kneaded material cooled as described above was roughly crushed to prepare a colorant masterbatch having an average particle size of not more than 1.0 mm. The kneaded material was roughly crushed using a hammer mill.

Resin-Solution Preparing Step

A resin solution was prepared by mixing 97.5 parts by weight of the above colorant masterbatch with 175 parts by weight of methyl ethyl ketone, 172.3 parts by weight of the above polyester resin, and 55.3 parts by weight of a rosin-modified maleic resin (the trade name "MALKYD No. 1", manufactured by Arakawa Chemical Industries, Ltd.; acid value: 25 mg KOH/g or less; softening point: 120° C. to 130° C.; weight average molecular weight: 3,100) using a high-speed disperser (T.K. ROBOMIX/T.K. HOMO DISPER Model 2.5, manufactured by PRIMIX Corporation) and then adding 1.38 parts by weight of an emulsifier (the trade name "Neogen SC-F", manufactured by Dai-Ichi Kogyo Seiyaku Co., Ltd.). In this solution, the pigment was evenly microdispersed.

O/W-Emulsion Preparing Step

Next, an O/W emulsion in which dispersoids containing the resin material were dispersed was prepared through the formation of an W/O emulsion by adding 72.8 parts by weight of 1 N aqueous ammonia to the resin solution in the container, sufficiently stirring the solution using a high-speed disperser (T.K. ROBOMIX/T.K. HOMO DISPER Model 2.5, manufactured by PRIMIX Corporation) at an impeller tip speed of 7.5 m/s, adjusting the temperature of the solution in the flask to 25° C., dropping 400 parts by weight of deionized water with stirring at an impeller tip speed of 14.7 m/s, and adding 100 parts by weight of deionized water while continuing stirring.

Coalescing Step

Next, the O/W emulsion was transferred into a stirring container equipped with a Maxblend impeller, and the temperature of the O/W emulsion was adjusted to 25° C. with stirring at an impeller tip speed of 1.0 m/s. Next, the dispersoids were coalesced to form coalesced particles by dropping 200 parts by weight of a 5.0% aqueous sodium sulfate solution while maintaining the same temperature and stirring conditions. After the dropping, the stirring was continued until the coalesced particles grew to a 50% volume particle size Dv(50) (μm) of 2.5 μm. When the coalesced particles grew to a Dv(50) of 2.5 μm, the coalescing was terminated by adding 200 parts by weight of deionized water.

Organic-Solvent Removing Step

Next, the O/W emulsion containing the coalesced particles was placed under reduced pressure to remove the organic solvent until the solid content thereof reached 23% by weight, thus obtaining a slurry (dispersion) of toner.

Cleaning Step (First Cleaning Step)

Next, the slurry (dispersion) was cleaned by repeating solid-liquid separation and redispersion in water (reslurrying). The cleaning was continued until a supernatant liquid taken from the slurry had a conductivity of 20 μs/cm or less.

Subsequently, a wet cake of toner (toner particle cake) was obtained by suction filtration. The wet cake was then dispersed in water, thus obtaining a dispersion (aqueous dispersion) containing the cleaned toner.

First Surface-Modifying Step

Next, the hydrogen ion exponent (pH) of the dispersion (aqueous dispersion) containing the cleaned toner was adjusted to 4.0 by adding 1 N hydrochloric acid.

Subsequently, the dispersion (aqueous dispersion) whose hydrogen ion exponent (pH) was adjusted to 4.0 was stirred while dropping polyethyleneimine (weight average molecular weight: 70,000). The polyethyleneimine was added in an amount of 1.0 part by weight on the basis of 100 parts by weight of the rosin resin. The dispersion was then further stirred for two hours so that the composition of the entire dispersion became sufficiently uniform.

Cleaning Step (Second Cleaning Step)

Next, the dispersion in which the toner having the surfaces thereof modified with polyethyleneimine were dispersed was washed by repeating solid-liquid separation and redispersion in water (reslurrying). Thus, a dispersion (aqueous dispersion) containing the washed toner was obtained. When the liquid phase or filtrate separated by solid-liquid separation was examined, no polyethyleneimine was detected therein. In addition, the resultant aqueous dispersion had a pH of 9.0.

Second Surface-Modifying Step

Next, a silicone emulsion (KM-9717, manufactured by Shin-Etsu Chemical Co., Ltd.; anionic and containing MQ resin) was added to the resultant aqueous dispersion so that the amount of silicone resin in the silicone emulsion was 0.4 parts by weight on the basis of 100 parts by weight of the resin material.

The dispersion was then further stirred for two hours to allow the silicone resin (MQ resin) to adhere to the toner.

Washing Step (Third Washing Step)

Next, the dispersion in which the toner were dispersed was washed by repeating solid-liquid separation and redispersion in water (reslurrying). Subsequently, a wet cake of toner (toner particle cake) was obtained by suction filtration. The wet cake thus obtained had a water content of 35% by weight.

Drying Step

Subsequently, the resultant wet cake was dried using a vacuum dryer, thus obtaining toner.

Dispersion Step

Placed in a ceramic pot (internal volume: 600 mL) were 50 parts by weight of the toner prepared by the above method, 50 parts by weight of an acrylic-polysiloxane graft copolymer solution (KP-575, manufactured by Shin-Etsu Chemical Co., Ltd.; comonomers: acrylates/ethylhexyl acrylate/dimethylpolysiloxane methacrylate; solvent: decamethylcyclopentasiloxane; solid content: 30% by weight), 75 parts by weight of a dimethyl silicone oil (KF-96, manufactured by Shin-Etsu Chemical Co., Ltd.), serving as a carrier liquid, and 75 parts by weight of a methyl hydrogen silicone oil (poly(methyl hydrogen siloxane), the trade name "KF-99", manufactured by Shin-Etsu Chemical Co., Ltd.; dynamic viscosity at 25° C.: 20 $mm^2/s$). Then, zirconia balls (ball diameter: 1 mm) were placed in the ceramic pot so that the volume percentage thereof was 85%, and the mixture was subjected to dispersion using a tabletop pot mill at a rotational speed of 230 rpm for 24 hours. Thus, a liquid developer was obtained.

The 50% volume particle size Dv(50) (μm) of the toner in the resultant liquid developer was 2.05 μm, where the Dv(50) (μm) of the resultant toner was measured using Microtrac MT-3000 (manufactured by Nikkiso Co., Ltd.). Similarly, the particle sizes of the particles prepared in the examples and comparative examples described below were measured.

In addition, the viscosity of the resultant liquid developer at 25° C. was 90 mPa·s.

Also, a magenta liquid developer, a yellow liquid developer, and a black liquid developer were produced in the same manner as above except that the cyan pigment was replaced with a magenta pigment, namely, Pigment Red 238 (manufactured by Sanyo Color Works, Ltd.), a yellow pigment, namely, Pigment Yellow 180 (manufactured by Clariant), or a black pigment, namely, carbon black (Printex L, manufactured by Degussa AG).

Examples 2 to 13

Liquid developers corresponding to the individual colors were produced in the same manner as in Example 1 except that the compositions of the liquid developers, the presence or absence of the first and second surface-modifying steps for the parent toner, and the conditions thereof were changed as in Table 1.

Example 14

Preparation of Colorant Masterbatch

First, 48 parts by weight of a polyester resin (acid value: 10 mg KOH/g; glass transition point (Tg): 55° C.; softening point: 107° C.) and 12 parts by weight of a rosin-modified maleic resin (the trade name "MALKYD No. 1", manufactured by Arakawa Chemical Industries, Ltd.; acid value: 25 mg KOH/g or less; softening point: 120° C. to 130° C.; weight average molecular weight: 3,100) were prepared as a resin material.

Next, the above resin material was mixed with a cyan pigment (Pigment Blue 15:3, manufactured by Dainichiseika Color & Chemicals Mfg. Co., Ltd.), serving as a colorant, in a mass ratio of 50:50. These components were mixed using a 20 L Henschel mixer to prepare a raw material for production of toner.

Next, the raw material (mixture) was kneaded using a double-screw kneading and extruding machine. The kneaded material extruded from an extrusion port of the double-screw kneading and extruding machine was cooled.

The kneaded material cooled as described above was roughly crushed to prepare a colorant masterbatch having an average particle size of not more than 1.0 mm. The kneaded material was roughly crushed using a hammer mill.

Preparation of Toner

Next, 15 parts by weight of the above colorant masterbatch, 68 parts by weight of the above polyester resin, and 17 parts by weight of the above rosin-modified maleic resin were kneaded using a double-screw kneading and extruding machine. The kneaded material extruded from an extrusion port of the double-screw kneading and extruding machine was cooled. The resultant kneaded material was crushed using a hammer mill to prepare toner.

Dispersion Step

Placed in a wide-mouthed polypropylene bottle were 50 parts by weight of the toner prepared by the above method, 50 parts by weight of an acrylic-polysiloxane graft copolymer solution (KP-541, manufactured by Shin-Etsu Chemical Co., Ltd.; comonomers: alkyl acrylate/dimethylpolysiloxane; solvent: isopropanol; solid content: 60% by weight), and 150 parts by weight of a mineral oil (Isopar G, manufactured by ExxonMobil Chemical Company), serving as a carrier liquid. Then, 300 parts by weight of 3 mm glass beads were placed in the wide-mouthed polypropylene bottle, and the mixture was subjected to dispersion using a rocking mill (RM-05S, manufactured by Seiwa Giken Co., Ltd.) at an inverter frequency of 52 Hz for 90 minutes. Subsequently, the glass beads were removed, and the resultant liquid was passed through a stainless steel sieve (opening size: 150 μm) to remove dust and coarse particles. Thus, a liquid developer was obtained.

The 50% volume particle size Dv(50) of the toner in the resultant liquid developer was 4.94 μm. In addition, the viscosity of the resultant liquid developer at 25° C. was 40 mPa·s. Also, a magenta liquid developer, a yellow liquid developer, and a black liquid developer were produced in the same manner as above except that the cyan pigment was replaced with a magenta pigment, namely, Pigment Red 238 (manufactured by Sanyo Color Works, Ltd.), a yellow pigment, namely, Pigment Yellow 180 (manufactured by Clariant), or a black pigment, namely, carbon black (Printex L, manufactured by Degussa AG).

Example 15

Preparation of Colorant Masterbatch

First, 48 parts by weight of a polyester resin (acid value: 10 mg KOH/g; glass transition point (Tg): 55° C.; softening point: 107° C.) and 12 parts by weight of a rosin-modified maleic resin (the trade name "MALKYD No. 1", manufactured by Arakawa Chemical Industries, Ltd.; acid value: 25 mg KOH/g or less; softening point: 120° C. to 130° C.; weight average molecular weight: 3,100) were prepared as a resin material.

Next, the above resin material was mixed with a cyan pigment (Pigment Blue 15:3, manufactured by Dainichiseika Color & Chemicals Mfg. Co., Ltd.), serving as a colorant, in a mass ratio of 50:50. These components were mixed using a 20 L Henschel mixer to prepare a raw material for production of toner.

Next, the raw material (mixture) was kneaded using a double-screw kneading and extruding machine. The kneaded material extruded from an extrusion port of the double-screw kneading and extruding machine was cooled.

The kneaded material cooled as described above was roughly crushed to prepare a colorant masterbatch having an average particle size of not more than 1.0 mm. The kneaded material was roughly crushed using a hammer mill.

Preparation of Toner

Next, 15 parts by weight of the above colorant masterbatch, 68 parts by weight of the above polyester resin, and 17 parts by weight of the above rosin-modified maleic resin were kneaded using a double-screw kneading and extruding machine. The kneaded material extruded from an extrusion port of the double-screw kneading and extruding machine was cooled. The resultant kneaded material was crushed using a hammer mill to prepare toner.

Dispersion Step

Placed in a ceramic pot were 32 parts by weight of the toner prepared by the above method, 18 parts by weight of an alkyl acrylate/dimethylpolysiloxane copolymer (KP-545, manufactured by Shin-Etsu Chemical Co., Ltd.; comonomers: alkyl acrylate/dimethylpolysiloxane; solvent: cyclopentasiloxane; solid content: 30% by weight), 80 parts by weight of a dimethyl silicone oil (KF-96-50cs, manufactured by Shin-Etsu Chemical Co., Ltd.), and 0.4 parts by weight of polyethyleneimine. Then, 800 parts by weight of 2 mm zirconia beads were placed in the ceramic pot, and the mixture was crushed using a planetary ball mill. Subsequently, the zirconia beads were removed, and the resultant liquid was passed through a stainless steel sieve (opening size: 150 μm) to remove dust and coarse particles. Thus, a liquid developer was obtained.

The 50% volume particle size Dv(50) of the toner in the resultant liquid developer was 3.2 μm.

Also, a magenta liquid developer, a yellow liquid developer, and a black liquid developer were produced in the same manner as above except that the cyan pigment was replaced with a magenta pigment, namely, Pigment Red 238 (manufactured by Sanyo Color Works, Ltd.), a yellow pigment, namely, Pigment Yellow 180 (manufactured by Clariant), or a black pigment, namely, carbon black (Printex L, manufactured by Degussa AG).

Examples 16 to 19

Liquid developers corresponding to the individual colors were produced in the same manner as in Example 15 except that the proportions of the individual components were changed as in Table 1.

Comparative Examples 1 and 2

Liquid developers corresponding to the individual colors were produced in the same manner as in Example 1 except that the compositions of the liquid developers, the presence or absence of the first and second surface-modifying steps for the parent toner, and the conditions thereof were changed as in Table 1.

The compositions and other properties of the liquid developers of the above examples and comparative examples are shown in Table 1.

In Table 1, KM-9717 is a silicone resin (MQ resin, manufactured by manufactured by Shin-Etsu Chemical Co., Ltd.), X-51-1302M is a silicone resin (MQ resin, manufactured by Shin-Etsu Chemical Co., Ltd.), KM-9738 is a silicone resin (dimethyl silicone, manufactured by Shin-Etsu Chemical Co., Ltd.), X-52-8001 is a silicone resin (mercapto-containing silicone, manufactured by Shin-Etsu Chemical Co., Ltd.), and X-51-1264 is a silicone resin (epoxy-containing silicone, manufactured by Shin-Etsu Chemical Co., Ltd.). In addition, PEs denotes a polyester resin, RM denotes a rosin-modified maleic resin, RPES denotes a rosin-modified polyester resin (the trade name "TFS-015", manufactured by Arakawa Chemical Industries, Ltd.; acid value: 11.8 mg KOH/g or less; softening point: 79° C.; weight average molecular weight: 1,300), H1 denotes a methyl hydrogen silicone oil (dynamic viscosity at 25° C.: 20 $mm^2/s$), H2 denotes a methyl hydrogen silicone oil (dynamic viscosity at 25° C.: 40 $mm^2/s$), H3 denotes a methyl hydrogen silicone oil (dynamic viscosity at 25° C.: 100 $mm^2/s$), KF96 denotes a dimethyl silicone oil (KF-96, manufactured by Shin-Etsu Chemical Co., Ltd.), KF-96-50cs denotes a dimethyl silicone oil (KF-96-50cs, manufactured by Shin-Etsu Chemical Co., Ltd.), ISOPAR G denotes a mineral oil (Isopar G manufactured by ExxonMobil Chemical Company), S1 denotes decamethylcyclopentasiloxane, S2 denotes methyltris(trimethylsiloxy)silane, BuAc denotes butyl acetate, iD denotes isododecane, iP denotes isopropanol, and cPS denotes cyclopentasiloxane. In addition, KP-575 is an acrylic-polysiloxane graft copolymer solution (manufactured by Shin-Etsu Chemical Co., Ltd.; comonomers: acrylates/ethylhexyl acrylate/dimethylpolysiloxane methacrylate; solvent: decamethylcyclopentasiloxane; solid content: 30% by weight), KP-543 is an acrylic-polysiloxane graft copolymer solution (manufactured by Shin-Etsu Chemical Co., Ltd.; comonomers: alkyl acrylate/dimethylpolysiloxane; solvent: butyl acetate, solid content: 50% by weight), KP-549 is an acrylic-polysiloxane graft copolymer solution (manufactured by Shin-Etsu Chemical Co., Ltd., comonomers: alkyl acrylate/dimethylpolysiloxane; solvent: methyltris(trimethylsiloxy)silane; solid content: 40% by weight), KP-550 is an acrylic-polysiloxane graft copolymer solution (manufactured by Shin-Etsu Chemical Co., Ltd., comonomers: alkyl acrylate/dimethylpolysiloxane, solvent: isododecane; solid content: 40% by weight), KP-541 is an acrylic-polysiloxane graft copolymer solution (manufactured by Shin-Etsu Chemical Co., Ltd.; comonomers: alkyl acrylate/dimethylpolysiloxane; solvent: isopropanol; solid content: 60% by weight), and KP-545 is an acrylic-polysiloxane graft copolymer solution (manufactured by Shin-Etsu Chemical Co., Ltd.; comonomers: alkyl acrylate/dimethylpolysiloxane; solvent: cyclopentasiloxane; solid content: 30% by weight). In addition, PEI treatment refers to surface modification with polyethyleneimine (first surface-modifying step), and silicone resin treatment refers to surface modification with a silicone resin (second surface-modifying step). In addition, the contents of the acrylic-polysiloxane graft copolymers shown in Table 1 are the net contents of the acrylic-polysiloxane graft copolymers in the acrylic-polysiloxane graft copolymer solutions (the solid contents of the solutions).

TABLE 1

| | Toner | | | | | | Carrier liquid | | Acrylic-polysiloxane graft copolymer | | | |
|---|---|---|---|---|---|---|---|---|---|---|---|---|
| | Resin material | | PEI treatment | Silicone resin treatment | | | | | | | Amount used relative to amount of toner | |
| | Type | Content in resin material (wt %) | Presence or absence of treatment | Presence or absence of treatment | Type | Content (wt %) | Type | Content (wt %) | Type | Content (wt %) | (wt %/wt %) | Viscosity (mPa · s) |
| Ex. 1 | RM/PEs | 20/80 | Performed | Performed | KM-9717 | 20 | KF96/H1/S1 | 27/27/20 | KP-575 | 6.0 | 0.3 | 90 |
| Ex. 2 | RM/PEs | 20/80 | Performed | Performed | KM-9717 | 20 | KF96/H2/S1 | 22.7/22.6/26.7 | KP-575 | 8.0 | 0.4 | 70 |
| Ex. 3 | RM/PEs | 20/80 | Performed | Performed | KM-9717 | 20 | KF96/H1/S1 | 18.3/18.3/33.3 | KP-575 | 10 | 0.5 | 80 |
| Ex. 4 | RPES/PEs | 20/80 | Performed | Performed | KM-9717 | 20 | KF96/H3/S1 | 31.3/31.3/13.3 | KP-575 | 4.0 | 0.2 | 80 |
| Ex. 5 | RPES/PEs | 20/80 | Performed | Performed | X-51-1302M | 20 | KF96/H1/S1 | 35.6/35.7/6.7 | KP-575 | 2.0 | 0.1 | 120 |
| Ex. 6 | RPES/PEs | 20/80 | Performed | Performed | KM-9738 | 20 | KF96/H1/S1 | 37.8/37.8/3.3 | KP-575 | 1.0 | 0.05 | 150 |
| Ex. 7 | RM/PEs | 20/80 | Performed | Performed | X-52-8001 | 20 | KF96/H1/S1 | 14/14/40 | KP-575 | 12 | 0.6 | 50 |
| Ex. 8 | RM/PEs | 20/80 | Performed | Performed | X-51-1264 | 20 | KF96/BuAc | 62/12 | KP-543 | 6.0 | 0.3 | 120 |
| Ex. 9 | RM/PEs | 20/80 | Performed | Performed | KM-9717 | 20 | KF96/S1 | 54/20 | KP-545 | 6.0 | 0.3 | 90 |
| Ex. 10 | RM/PEs | 20/80 | Performed | Performed | KM-9717 | 20 | KF96/S2 | 59/15 | KP-549 | 6.0 | 0.3 | 90 |
| Ex. 11 | RM/PEs | 20/80 | Performed | Performed | KM-9717 | 20 | KF96/iD | 59/15 | KP-550 | 6.0 | 0.3 | 90 |
| Ex. 12 | RM/PEs | 20/80 | Performed | None | — | 20 | KF96/S1 | 54/20 | KP-575 | 6.0 | 0.3 | 200 |
| Ex. 13 | RM/PEs | 20/80 | None | Performed | KM-9717 | 20 | KF96/S1 | 54/20 | KP-575 | 6.0 | 0.3 | 140 |
| Ex. 14 | RM/PEs | 20/80 | None | None | — | 20 | ISOPAR G/iP | 64/10 | KP-541 | 6.0 | 0.3 | 40 |
| Ex. 15 | RM/PEs | 20/80 | Performed | None | — | 24.8 | KF-96-50cs/cPS | 61.3/9.7 | KP-545 | 4.1 | 0.17 | 900 |
| Ex. 16 | RM/PEs | 20/80 | Performed | None | — | 24.8 | KF-96-50cs/cPS | 61.9/12.3 | KP-545 | 1.0 | 0.04 | 1,000 |
| Ex. 17 | RM/PEs | 20/80 | Performed | None | — | 24.8 | KF-96-50cs/cPS | 41.9/23.3 | KP-545 | 10 | 0.4 | 850 |
| Ex. 18 | RM/PEs | 20/80 | Performed | None | — | 24.8 | KF-96-50cs/cPS | 27.5/33.4 | KP-545 | 14.3 | 0.58 | 800 |
| Ex. 19 | RM/PEs | 20/80 | Performed | None | — | 24.8 | KF-96-50cs/cPS | 8.5/46.7 | KP-545 | 20 | 0.81 | 850 |
| Com. Ex. 1 | RM/PEs | 20/80 | None | None | — | 20 | KF96 | 80 | — | — | — | 1,500 |
| Com. Ex. 2 | RM/PEs | 20/80 | Performed | Performed | KM-9717 | 20 | KF96/H1 | 40/40 | — | — | — | 800 |

2. Evaluation

The individual liquid developers prepared as described above were evaluated as follows.

2.1 Dispersion Stability Test 2.1.1 First Method

After 10 mL of each liquid developer prepared in Examples and Comparative Examples was placed in a test tube (diameter: 12 mm; length: 120 mm) and was left standing at room temperature (25° C.) for ten days, the sedimentation depth was measured and was evaluated according to the following four criteria:

A: The sedimentation depth was 0 mm.

B: The sedimentation depth was more than 0 mm and not more than 2 mm.

C: The sedimentation depth was more than 2 mm and not more than 5 mm.

D: The sedimentation depth was more than 5 mm.

2.1.2 Second Method

After 45.5 mL of each liquid developer prepared in Examples and Comparative Examples was placed in a centrifuge tube and was processed using a centrifugal separator (manufactured by Kokusan Co., Ltd.) at a turning radius of 5 cm for three minutes for each of numbers of revolutions of 500, 1,000, 2,000, 4,000, and 5,000 rpm, the sedimentation depths for the individual numbers of revolutions were measured.

Based on the above measurement results, the sedimentation depth was plotted on the vertical axis against the centrifugal acceleration $r\omega^2$ ($r\omega^2$=1,118×turning radius (cm)× number of revolution per minute $(rpm)^2\times10^{-8}\times g$ (gravitational acceleration)) on the horizontal axis. Based on the plotted values, the gradient k was determined by linear approximation and was evaluated according to the following criteria, where the lower the value of k, the higher the dispersion stability:

A: $0\leq k<0.004$

B: $0.004\leq k<0.008$

C: $0.008\leq k<0.012$

D: $k\geq0.012$ 2.2 Long-Term Dispersion Stability Test

After 10 mL of each liquid developer prepared in Examples and Comparative Examples was placed in a test tube (diameter: 12 mm; length: 120 mm) and was left standing at 60° C. for 20 days, the sedimentation depth was measured and was evaluated according to the following four criteria:

A: The sedimentation depth was 0 mm.

B: The sedimentation depth was more than 0 mm and not more than 4 mm.

C: The sedimentation depth was more than 4 mm and not more than 8 mm.

D: The sedimentation depth was more than 8 mm.

2.3 Development Efficiency

Using an image-forming apparatus as shown in FIGS. 1 and 2, a liquid developer layer of each liquid developer prepared in Examples and Comparative Examples was formed on a developing roller of the image-forming apparatus. The photoreceptor was then uniformly charged to a surface potential of 500 V while charging the developing roller to a surface potential of 300 V and was exposed to attenuate the charge on the surface of the photoreceptor to a surface potential of 50 V. After the liquid developer passed between the photoreceptor and the developing roller, toner on the developing roller and toner on the photoreceptor were collected with tapes. The tapes used for collection were laminated on recording paper to measure the densities of the toner. After the measurement, the development efficiency was calculated by dividing the density of the toner collected from the photoreceptor by the sum of the density of the toner collected from the photoreceptor and the density of the toner collected from the developing roller and then multiplying it by 100. The development efficiency was evaluated according to the following four criteria:

A: The development efficiency was 96% or more, that is, particularly superior.

B: The development efficiency was 90% to less than 96%, that is, superior.

C: The development efficiency was 80% to less than 90%, that is, practically acceptable.

D: The development efficiency was less than 80%, that is, inferior.

2.4 Transfer Efficiency

Using an image-forming apparatus as shown in FIGS. 1 and 2, a liquid developer layer of each liquid developer prepared in Examples and Comparative Examples was formed on a photoreceptor of the image-forming apparatus. After the liquid developer passed between the photoreceptor and the intermediate transfer member, toner on the photoreceptor and toner on the intermediate transfer member were collected with tapes. The tapes used for collection were laminated on recording paper to measure the densities of the toner. After the measurement, the transfer efficiency was calculated by dividing the density of the toner collected from the intermediate transfer member by the sum of the density of the toner collected from the photoreceptor and the density of the toner collected from the intermediate transfer member and then multiplying it by 100. The transfer efficiency was evaluated according to the following four criteria:

A: The transfer efficiency was 96% or more, that is, particularly superior.

B: The transfer efficiency was 90% to less than 96%, that is, superior.

C: The transfer efficiency was 80% to less than 90%, that is, practically acceptable.

D: The transfer efficiency was less than 80%, that is, inferior.

2.5 Positive Charging Properties

The potential difference of each liquid developer prepared in Examples and Comparative Examples was measured using a microscope-type laser zeta potential analyzer (ZC-2000, manufactured by Microtec Nition Co., Ltd.).

In the measurement, the liquid developer was diluted with a diluent solvent and was placed in a 10 mm square transparent cell, and a voltage of 300 V was applied at an interelectrode distance of 9 mm to observe migration of the particles in the cell using a microscope for calculation of migration speed. The zeta potential was then determined from the measurement. The potential difference was evaluated according to the following four criteria:

A: The potential difference was +100 mV or more (excellent).

B: The potential difference was +85 mV to less than +100 mV (good).

C: The potential difference was +70 mV to less than +85 mV (fair).

D: The potential difference was +50 mV to less than +70 mV (poor).

E: The potential difference was less than +50 mV (terrible).

Also, a portion of each liquid developer prepared in Examples and Comparative Examples was left standing at 60° C. for 20 days. Subsequently, the zeta potential was similarly measured and evaluated.

The results are shown in Table 2.

TABLE 2

| | Dispersion stability | | Long-term | | | Positive charging properties | |
|---|---|---|---|---|---|---|---|
| | First method | Second method | dispersion stability | Development efficiency | Transfer efficiency | Not left standing | After left standing |
| Ex. 1 | A | A | A | A | A | A | A |
| Ex. 2 | A | A | A | A | A | A | A |
| Ex. 3 | A | A | A | A | A | A | A |
| Ex. 4 | A | A | A | A | A | A | A |
| Ex. 5 | A | A | A | A | A | A | A |
| Ex. 6 | B | C | C | A | A | A | A |
| Ex. 7 | A | A | B | C | C | A | A |
| Ex. 8 | B | B | B | A | B | B | C |
| Ex. 9 | A | B | B | A | A | B | B |
| Ex. 10 | A | A | B | A | A | B | B |
| Ex. 11 | B | B | B | A | A | B | B |
| Ex. 12 | B | B | C | A | B | B | B |
| Ex. 13 | B | B | B | B | B | C | C |
| Ex. 14 | C | C | C | B | C | C | C |
| Ex. 15 | A | A | A | B | B | A | A |
| Ex. 16 | A | A | B | B | B | A | A |
| Ex. 17 | A | A | A | B | B | A | A |
| Ex. 18 | A | A | A | A | A | A | A |
| Ex. 19 | A | A | A | B | B | A | A |
| Com. Ex. 1 | D | D | D | D | D | E | E |
| Com. Ex. 2 | C | D | D | C | C | C | E |

As is obvious from Table 2, the liquid developers of the examples of the invention had superior dispersion stability and also had superior charging properties (positive charging properties), development efficiency, and transfer efficiency. In contrast, the liquid developers of the comparative examples did not achieve satisfactory results.

The charging properties of the liquid developers of Examples 1 to 7 were not degraded after they were left standing, whereas the charging properties of the liquid developer of Comparative Example 2 were degraded after it was left standing. This is because the acrylic-polysiloxane graft copolymer prevented deterioration of the hydrogen-modified silicone compound in Examples 1 to 7.

What is claimed is:

1. A liquid developer comprising:

toner that contains a resin and a pigment;

a carrier liquid in which the toner is dispersed; and a graft copolymer of an acrylic polymer and a polysiloxane;

wherein the resin contains a silicone resin having partial structures represented by unit formulas (1) and (2), wherein $R^1$, $R^2$, and $R^3$ are each independently a monovalent hydrocarbon group:

$$R^1R^2R^3SiO_{1/2} \quad (1)$$

$$SiO_{4/2} \quad (2).$$

2. The liquid developer according to claim 1, wherein the acrylic polymer contains an alkyl acrylate as a monomer.

3. The liquid developer according to claim 1, wherein the polysiloxane is dimethylpolysiloxane.

4. The liquid developer according to claim 3, wherein the polysiloxane is dimethylpolysiloxane having an acrylates.

5. The liquid developer according to claim 1, wherein the graft copolymer is contained in an amount of 10 to 50 parts by weight on the basis of 100 parts by weight of the toner.

6. The liquid developer according to claim 1, wherein the toner have surfaces modified with a polyalkyleneimine.

7. The liquid developer according to claim 1, wherein the resin material containing a rosin.

8. The liquid developer according to claim 1, wherein the carrier liquid contains a dimethyl silicone oil and a siloxane compound.

9. The liquid developer according to claim 1, wherein the silicone resin is present close to surfaces of the toner.

10. A process of preparing the liquid developer according to claim 1, the process comprising:

dispersing the toner in the carrier liquid containing the graft copolymer.

11. An image-forming apparatus comprising:

a liquid developer tank that stores the liquid developer and supplies the liquid developer to a developing section;

a developing section that forms an image using said liquid developer;

a transfer section that transfers the image developed by the developing section onto a recording medium; and a fixing section that fixes the image onto the recording medium;

wherein the liquid developer used by the developing section to form the image contains toner that contains a resin and a pigment, a carrier liquid in which the toner is dispersed, and a graft copolymer of an acrylic polymer and a polysiloxane; and wherein the resin contains a silicone resin having partial structures represented by unit formulas (1) and (2), wherein $R^1$, $R^2$, and $R^3$ are each independently a monovalent hydrocarbon group:

$$R^1R^2R^3SiO_{1/2} \quad (1)$$

$$SiO_{4/2} \quad (2).$$

12. The image-forming apparatus according to claim 11, wherein the silicone resin is present close to surfaces of the toner.

* * * * *